US010795274B1

(12) United States Patent
Nakashima et al.

(10) Patent No.: US 10,795,274 B1
(45) Date of Patent: Oct. 6, 2020

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Shinya Nakashima, Minamiashigara (JP); Shinya Sakamoto, Minamiashigara (JP); Tomohiro Shinya, Minamiashigara (JP); Naomi Miyamoto, Minamiashigara (JP); Masaki Iwase, Minamiashigara (JP); Ryutaro Kembo, Minamiashigara (JP); Tomohito Nakajima, Minamiashigara (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/531,250

(22) Filed: Aug. 5, 2019

(30) Foreign Application Priority Data

Mar. 26, 2019 (JP) ..... 2019-057797

(51) Int. Cl.

| | |
|---|---|
| ***G03G 9/08*** | (2006.01) |
| ***G03G 9/087*** | (2006.01) |
| ***G03G 9/093*** | (2006.01) |
| ***G03G 15/08*** | (2006.01) |

(52) U.S. Cl.
CPC ..... *G03G 9/08755* (2013.01); *G03G 9/0819* (2013.01); *G03G 9/0821* (2013.01); *G03G 9/0825* (2013.01); *G03G 9/0827* (2013.01); *G03G 9/09321* (2013.01); *G03G 9/09371* (2013.01); *G03G 15/0865* (2013.01)

(58) Field of Classification Search
CPC ..... G03G 9/0821; G03G 9/0825
USPC ..... 430/110.1, 110.2
See application file for complete search history.

(56) References Cited

U.S. PATENT DOCUMENTS

| | | | | |
|---|---|---|---|---|
| 2015/0268574 | A1* | 9/2015 | Miyaake ..... | G03G 9/08733 430/109.4 |
| 2017/0307993 | A1 | 10/2017 | Sano et al. | |
| 2018/0004106 | A1 | 1/2018 | Matsui et al. | |

FOREIGN PATENT DOCUMENTS

| | | | |
|---|---|---|---|
| JP | 2014-6339 | A | 1/2014 |
| JP | 2016-114782 | A | 6/2016 |
| JP | 2017-198980 | A | 11/2017 |
| JP | 2018-10286 | A | 1/2018 |

* cited by examiner

*Primary Examiner* — Mark A Chapman
(74) *Attorney, Agent, or Firm* — Sughrue Mion, PLLC

(57) ABSTRACT

An electrostatic charge image developing toner includes a continuous phase containing a binder resin (i); and a discontinuous phase that has a core containing a binder resin (ii) and a coating layer covering the core and containing a binder resin (iii), and is dispersed in the continuous phase.

14 Claims, 3 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims a priority under 35 USC 119 from Japanese Patent Application No. 2019-057797 filed on Mar. 26, 2019.

BACKGROUND

Technical Field

The present invention relates to an electrostatic charge image developing toner, an electrostatic charge image developer, and a toner cartridge.

Related Art

In the image forming apparatus, a toner image formed on an image holding member is transferred to a surface of a recording medium, and then the toner image is fixed on the recording medium by a fixing member which is heated and pressed in contact with the toner image to form an image.

As a toner used for such an image forming apparatus, for example, JP-A-2014-006339 discloses "a toner containing a polyester resin A, a polyester resin B, and a coloring agent, in which (1) the polyester resin A is a resin having a site capable of forming a crystal structure, (2) the polyester resin B is a resin having no site capable of forming a crystal structure, (3) in the cross-sectional area observation of the toner using a transmission electron microscope (TEM), the toner has domains derived from the polyester resin A in the toner cross section, and a long diameter of the domain which has the largest long diameter among the domains is 3.0 μm or more. (4) an average aspect ratio (long diameter/short diameter) of the domain is 4.0 to 20.0, and (5) a melting point Ta of the polyester resin A and a softening point Tb of the polyester resin B satisfy Expression "Ta<Tb".

In addition, JP-A-2018-010286 discloses "a toner having a toner particle containing a binder resin, a coloring agent, an amorphous polyester, and a crystalline polyester, in which the binder resin contains a vinyl resin, the amorphous polyester contains a monomer unit derived from linear aliphatic dicarboxylic acid having 6 to 12 carbon atoms and a monomer unit derived from dialcohol, the content of the monomer unit derived from the linear aliphatic dicarboxylic acid having 6 to 12 carbon atoms is 10% by mol to 50% by mol based on the entire monomer units derived from carboxylic acid of the amorphous polyester, in a cross section of the toner particle observed with a transmission electron microscope, the vinyl resin constitutes a matrix, the amorphous polyester constitutes a domain, and the crystalline polyester is present inside the domain.

In addition, JP-A-2016-114782 discloses "a toner includes a binder resin containing a polymer having a structural unit represented by a specific structural formula and has a structure in which optical purity X (%)=|X (L form)−X (D form)| is 80% or less, in terms of monomer component represented by the structural formula, here, X (L form) represents L form ratio (% by mol) in terms of monomer component, and X (D form) represents D form ratio (% by mol) in terms of monomer component, a domain is present in a matrix, and a small domain is present in the domain".

In addition, JP-A-2017-198980 discloses "a toner having a toner particle containing a binder resin, a coloring agent, a release agent, and a crystalline polyester, in which in a cross-sectional observation of the toner particle by a transmission electron microscope, a ratio of the toner particle in which a domain of the crystalline polyester and a domain of the release agent are observed in one particle is 70% by number or more in the toner, an arithmetic mean value of the maximum diameter of the domain of the release agent is 1.0 μm to 4.0 μm, and in a particle group consisting of the toner particle in which the domain of the crystalline polyester and the domain of the release agent are observed in one particle, conditions of (i) an average coverage of the domains of the release agent by the domain of the crystalline polyester is 80% or more, (ii) an average ratio of the area occupied by the domain of the crystalline polyester is 10.0% to 40.0% with respect to the cross-sectional area of the toner particle, and (iii) an average ratio of the area occupied by the domain of the release agent is 10.0% to 40.0% with respect to the cross-sectional area of the toner particle, are satisfied".

SUMMARY

In the image forming apparatus, a mechanical load is applied to the toner at various points such as stirring for charging which is applied to the toner by the developing unit. Then, white spots may occur in the image due to the toner deformed or fused by the load. Therefore, durability to the load is required for the toner.

Aspects of certain non-limiting embodiments of the present disclosure relate to an electrostatic charge image developing toner excellent in durability to a load as compared with a case of not having a configuration in which a discontinuous phase containing a binder resin is dispersed in a continuous phase containing the binder resin, that is, a case where the binder resin does not constitute the continuous phase and the discontinuous phase.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an electrostatic charge image developing toner containing a continuous phase containing a binder resin (i); and a discontinuous phase that has a core containing a binder resin (ii) and a coating layer covering the core and containing a binder resin (iii), and is dispersed in the continuous phase.

BRIEF DESCRIPTION OF THE DRAWINGS

Exemplary embodiment(s) of the present invention will be described in detail based on the following figures, wherein.

DETAILED DESCRIPTION

Hereinafter, the exemplary embodiment of the invention will be described.

Electrostatic Charge Image Developing Toner

An electrostatic charge image developing toner according to the exemplary embodiment (hereinafter, referred to as "toner") contains at least a binder resin. The toner contains a continuous phase containing the binder resin; and a discontinuous phase that is dispersed in the continuous phase, and the discontinuous phase has a core containing the binder resin and a coating layer covering the core and containing the binder resin.

The toner according to the exemplary embodiment has the above configuration, and thus is excellent in the durability to a load. The reason is presumed as follows.

In the image forming apparatus, a mechanical load is applied to the toner at various points. For example, in a developing unit in which the toner is charged by stirring, a load is applied to the toner during the stirring. The mechanical load applied to the toner tends to increase as the image-forming speed (a so-called process speed) of a machine is high. Then, in a case where a toner which is deformed or fused by applying a load is generated, white spots (image defects in which white dots are generated on an image portion formed on a recording medium) in the image due to the deformation or fusion of the toner may be generated. Therefore, durability to the load is required for the toner.

In contrast, the toner according to the exemplary embodiment has a structure in which the discontinuous phase in which the core containing the binder resin is covered with the coating layer containing the binder resin is dispersed in the continuous phase containing the binder resin.

Figure 1:
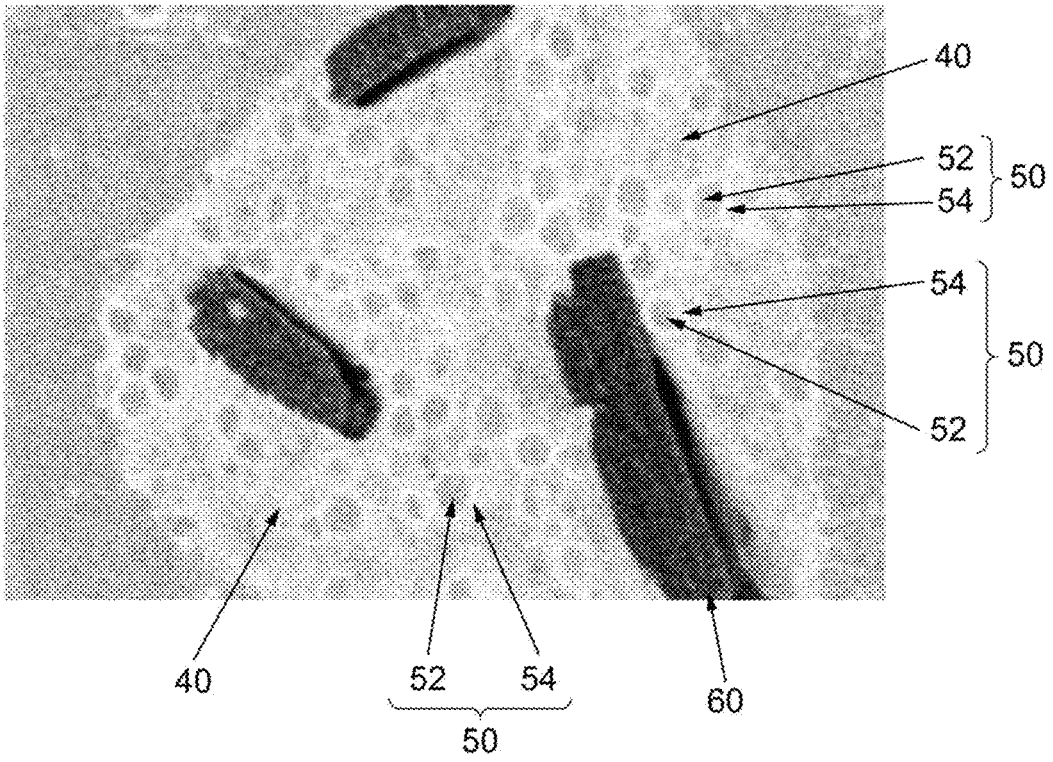
FIG. 1 is a cross-sectional image of an example of a toner according to the exemplary embodiment.

Here, the structure of the toner according to the exemplary embodiment will be described with reference to an example. FIG. 1 is a cross-sectional image of an example of a toner according to the exemplary embodiment. The toner as illustrated in FIG. 1 contains a continuous phase 40 containing a binder resin; and a discontinuous phase 50 that is dispersed in the continuous phase 40, and the discontinuous phase 50 has a core 52 containing the binder resin and a coating layer 54 covering the core 52 and containing the binder resin. That is, there is provided a structure in which the continuous phase 40 corresponding to sea and the discontinuous phase 50 corresponding to an island form a so-called sea-island structure, and the discontinuous phase 50 corresponding to the island contains the core 52 and the coating layer 54 around the core. The toner illustrated in FIG. 1 contains a releasing agent 60.

Therefore, the discontinuous phase in the toner functions as a filler, and as compared to a case where there is no discontinuous phase, that is, the binder resin does not form the continuous phase and the discontinuous phase, the hardness of the toner itself is increased to improve the durability to the load.

Binder Resin Contained in Continuous Phase, Core, and Coating Layer

The toner according to the exemplary embodiment at least contains the binder resin in the core and the coating layer forming the discontinuous phase and the continuous phase. Note that, in the following description, the binder resin contained in the continuous phase is referred as "(i)", the binder resin contained in the core is referred as "(ii)", and the binder resin contained in the coating layer is referred as "(iii)".

The binder resin (i) contained in the continuous phase, the binder resin (ii) contained in the core, and the binder resin (iii) contained in the coating layer may be the same as or different from each other. Here, examples of "different resins from each other" include resins having different structures as constituent units in polymer chains (for example, synthesized using monomers of different molecular structure as a raw material of the resin), and resins having the same structure of constituent units in the polymer chain but different average molecular weights.

Binder Resin (i) Contained in Continuous Phase

The continuous phase preferably contains an amorphous resin and a crystalline resin as the binder resin (i). When containing the crystalline resin in the continuous phase, the low temperature fixability is likely to be enhanced. Note that, from the viewpoint of the improvement of the low temperature fixability, it is more preferable that the continuous phase contains an amorphous polyester resin and a crystalline polyester resin (here, in the following description, the amorphous polyester resin contained in the continuous phase is referred as "A1", and the crystalline polyester resin contained in the continuous phase is referred as "C").

A weight ratio of the crystalline resin to the amorphous resin contained in the continuous phase (more preferably a weight ratio (C/A1) of the crystalline polyester resin C to the amorphous polyester resin A1) is preferably 0.12 to 0.40, is more preferably 0.15 to 0.35, and is still more preferably 0.20 to 0.30.

When the weight ratio of the crystalline resin to the amorphous resin (more preferably, the weight ratio (C/A1) of the crystalline polyester resin C to the amorphous polyester resin A1) is 0.12 or more, the low temperature fixability is likely to be enhanced; on the other hand, the weight ratio is 0.40 or less, the fixing strength of an image (particularly, the strength of the fixed image against scratching) is likely to be enhanced, and the hot offset resistance is likely to be enhanced.

In addition, one or more kinds of the amorphous resin and the crystalline resin contained in the continuous phase may be used. In addition, one or more kinds of the amorphous polyester resin A1 and the crystalline polyester resin C contained in the continuous phase may be used.

In the entire binder resins contained in the continuous phase, a total content of the amorphous polyester resin A1 and the crystalline polyester resin C is preferably 50% by weight or more, is more preferably 80% by weight or more, and is still more preferably 100% by weight.

Binder Resin (ii) Contained in Core

The core preferably contains an amorphous resin (more preferably an amorphous polyester resin) as a binder resin (ii). When the amorphous resin (more preferably, amorphous polyester resin) is contained in the core, the durability to the load is likely to be enhanced.

In addition, as described below, in a case where a glass-transition temperature Tg of the binder resin (iii) contained in the coating layer is lower than the fixing temperature, it is more preferable to contain the amorphous resin (more preferably the amorphous polyester resin) in the core. Since the amorphous resin in the core is melted out of the discontinuous phase at the time of fixing, the fixing strength of the image (particularly the strength of the fixed image against scratching) is likely to be enhanced, and the low temperature fixability is likely to be enhanced. Here, in the following description, the amorphous polyester resin contained in the core is referred as "A2".

In addition, one or more kinds of the amorphous resin (more preferably amorphous polyester resin A2) contained in the core may be used.

In the entire binder resins contained in the core, the content of the amorphous polyester resin A2 is preferably 50% by weight or more, is more preferably 80% by weight or more, and is still more preferably 100% by weight.

Binder Resin (iii) Contained in Coating Layer

The binder resin (iii) contained in the coating layer is preferably a binder resin having a different structure as a composition unit in the polymer chain with respect to the binder resin (i) contained in the continuous phase and the binder resin (ii) contained in the core. When the binder resin (iii) contained in the coating layer has a different structure as a composition unit in the polymer chain with respect to the binder resins contained in the continuous phase and the core, it is likely to form a structure of the toner according to the exemplary embodiment, that is, a structure (so-called sea-island structure) having the continuous phase and the discontinuous phase containing the core and the coating layer covering the core.

In addition, the binder resin (iii) contained in the coating layer preferably forms a chemical bond at the interface between the core and the coating layer with respect to the binder resin (ii) contained in the core. When the chemical bond is formed by the binder resin, the strength at the interface between the core and the coating layer is enhanced, and the durability to the load is likely to be enhanced. In addition, it is likely to form the structure of the toner according to the exemplary embodiment, that is, a structure (so-called sea-island structure) having the continuous phase and the discontinuous phase containing the core and the coating layer covering the core.

As described above, the binder resin (iii) contained in the coating layer is preferably a binder resin having a different structure as a composition unit in the polymer chain with respect to the binder resin (i) and the binder resin (ii), and preferably forms a chemical bond at the interface between the core and the coating layer with respect to the binder resin (ii). Further, from the viewpoint of that it is likely to form the structure of the toner according to the exemplary embodiment, that is, a structure (so-called sea-island structure) having the continuous phase and the discontinuous phase containing the core and the coating layer covering the core, the binder resin (iii) contained in the coating layer preferably has low compatibility with the binder resin (i) and the binder resin (ii).

From this viewpoint, in a case where the continuous phase contains the amorphous polyester resin A1 and the crystalline polyester resin C, and the core contains the amorphous polyester resin A2, the coating layer preferably contains a vinyl resin (here, in the following description, a vinyl resin contained in the coating layer is referred as "B").

The binder resin (iii) contained in the coating layer (more preferably vinyl resin B) preferably has a glass-transition temperature Tg which is lower than the fixing temperature, that is, a set temperature at the time of fixing in the image forming apparatus. When the glass-transition temperature Tg of the binder resin (iii) (more preferably vinyl resin B) is lower than the fixing temperature, the amorphous resin in the core is likely to be melted out of the discontinuous phase at the time of fixing so that the fixing strength of the image (particularly, the strength of the fixed image against scratching) is likely to be enhanced, and the hot offset resistance is likely to be enhanced.

From the viewpoint of enhancing the fixing strength of the image and the low temperature fixability, the glass-transition temperature Tg of the binder resin (iii) contained in the coating layer is preferably 40° C. or lower, is more preferably 30° C. or lower, and is still more preferably 20° C. or lower.

On the other hand, the glass-transition temperature Tg of the binder resin (iii) is preferably −70° C. or higher, and is more preferably −50° C. or higher, and is still more preferably −40° C. or higher from the viewpoint of enhancing the strength of the coating layer and enhancing the durability of the toner to the load.

The glass-transition temperature Tg of the binder resin (iii) is obtained from a DSC curve obtained by differential scanning calorimetry (DSC). More specifically the glass-transition temperature is obtained from "extrapolated glass transition onset temperature" described in the method of obtaining a glass-transition temperature in JIS K 7121-1987 "testing methods for transition temperatures of plastics".

In addition, one or more kinds of the binder resin (more preferably vinyl resin B) contained in the coating layer may be used.

In the entire binder resins contained in the coating layer, the content of the vinyl resin B is preferably 50% by weight or more, is more preferably 80% by weight or more, and is still more preferably 100% by weight.

Relationship Between Binder Resin (i) Contained in Continuous Phase and Binder Resin (ii) Contained in Core In a case where the continuous phase contains an amorphous resin (more preferably amorphous polyester resin A1) as the binder resin (i) and the core contains an amorphous resin (more preferably amorphous polyester resin A2) as the binder resin (ii), the amorphous resins (more preferably amorphous polyester resins A1 and A2) contained in the continuous phase and the core may be the same as or different from each other.

When the glass-transition temperature Tg of the binder resin (iii) (more preferably, the vinyl resin B) contained in the coating layer is lower than the fixing temperature, the compatibility between the amorphous resins (more preferably amorphous polyester resins A1 and A2) contained in the continuous phase and the core is preferably high. Due to the high compatibility between the amorphous resins, the amorphous resin in the core is melted out of the discontinuous phase at the time of fixing and is compatible with the amorphous resin in the continuous phase, so that the fixing strength of the image (particularly, the strength of the fixed image against scratching) is likely to be enhanced, and the hot offset resistance is likely to be enhanced.

Here, as an index of the compatibility, a difference in SP values of the amorphous resin contained in the continuous phase and the amorphous resin contained in the core (more preferably amorphous polyester resin A1 and amorphous polyester resin A2) is preferably 0.20 or lower, and is more preferably 0.15 or lower.

Here, in the exemplary embodiment, the SP value (unit: $(cal/cm^3)^{1/2}$) of the resin is calculated by the method of Fedor. Specifically, the SP value is calculated by the following equation.

$$\text{SP value}=\sqrt{(Ev/v)}=\sqrt{(\Sigma\Delta ei/\Delta vi)}$$

In the equation, Ev represents evaporation energy (cal/mol), v represents molar volume ($cm^3$/mol), Δei represents evaporation energy of each atom or atomic group, and Δvi represents molar volume of each atom or atomic group.

The details of this calculation method are described in Polym. Eng. Sci., Vol. 14, p. 147 (1974), Junji Mukai et al.

(1981), "A practical polymer for engineers", Kodansha, p. 66, Polymer Handbook (The fourth edition, Willey-interscience Publication) and the like, and the same method is applied to the exemplary embodiment. In the exemplary embodiment, $(cal/cm^3)^1$ is adopted as a unit of the SP value, but the unit is omitted and described without dimension according to the practice.

In addition, from the viewpoint of enhancing the compatibility, the amorphous polyester resin A1 contained in the continuous phase and the amorphous polyester resin A2 contained in the core are preferably a resin having at least one of the structure derived from bisphenol A propylene oxide adduct and a structure derived from bisphenol A ethylene oxide adduct of 50% by weight or more, more preferably 60% by weight or more, and still more preferably 70% by weight or more, in total.

Note that, in the amorphous polyester resins A1 and A2, the upper limit value of a total amount of the structure derived from bisphenol A propylene oxide adduct and the structure derived from bisphenol A ethylene oxide adduct is not particularly limited as long as it is within a range where a polyester resin can be constituted. That is, if the amorphous polyester resins A1 and A2 are condensation polymers of polyvalent carboxylic acid and polyvalent alcohol, it is not particularly limited as long as it is within the range of the ratio of polyvalent carboxylic acid and polyvalent alcohol, which can constitute the polyester resin.

Note that, in the amorphous polyester resins A1 and A2, the total amount of the structure derived from bisphenol A propylene oxide adduct and the structure derived from bisphenol A ethylene oxide adduct can be obtained by analysis using NMR.

From the viewpoint of enhancing the compatibility, the amorphous resin contained in the continuous phase and the amorphous resin contained in the core (more preferably, amorphous polyester resin A1 and amorphous polyester resin A2) is preferably a resin which has only the composition unit of the same structure as a composition unit in a polymer chain (for example, it is synthesized using only the monomer having the same molecular structure as a raw material of the resin).

In addition, the analysis of the composition unit of the resin in a polymer chain can be performed by NMR.

Properties of Discontinuous Phase

When the cross section of the toner is observed, the ratio of the area occupied by the discontinuous phase to the cross-sectional area of the toner is preferably 5% to 15%, is more preferably 6% to 14%, and is still more preferably 7% to 12%.

When the ratio of the area occupied by the discontinuous phase is 5% or more, a large number of discontinuous phases that exhibit the function as a filler are present, and the durability of the toner to the load is likely to be enhanced. In addition, in a case where the glass-transition temperature Tg of the binder resin (iii) contained in the coating layer is lower than the fixing temperature, and the core contains an amorphous resin (more preferably amorphous polyester resin A2), the amount of the amorphous resins melted out of the core at the time of fixing is increased, so that the fixing strength of the image (particularly, the strength of the fixed image against scratching) is likely to be enhanced, and the hot offset resistance is likely to be enhanced.

On the other hand, when the ratio of the area occupied by the discontinuous phase is 15% or less, it is easy to obtain a flexible toner by not having excessively large amount of discontinuous phases. In a case where the continuous phase contains the amorphous resin and the crystalline resin (more preferably, amorphous polyester resin A1 and crystalline polyester resin C), the low temperature fixability is likely to be enhanced by not having excessively small amount of continuous phase.

The average equivalent circle diameter L1 of the discontinuous phase is preferably 100 nm to 300 nm, and is more preferably 120 nm to 250 nm.

When the average equivalent circle diameter of the discontinuous phase is 100 nm or larger, the toner manufacturability, particularly the controllability of the toner particle diameter, and the controllability of the toner shape is likely to be improved.

On the other hand, when the average equivalent circle diameter is 300 nm or smaller, the inclusion of the discontinuous phase (that is, island) in the continuous layer (that is, the sea) is likely to be enhanced, and the durability of the toner to the load is likely to be enhanced. Therefore, it is likely to suppress white spots in the image resulting from the deformation or fusion of the toner.

An average thickness L2 of the coating layer is preferably 25 nm to 50 nm, and is more preferably 30 nm to 40 nm.

When the average thickness of the coating layer is 25 nm or more, the mixing of the continuous phase and the core during the production of the toner is suppressed, so that the durability of the toner to the load is likely to be enhanced.

On the other hand, when the average thickness is 50 nm or less, the low temperature fixability is likely to be enhanced.

A ratio L2/L1 of the average equivalent circle diameter L1 of the discontinuous phase to the average thickness L2 of the coating layer is preferably 0.12 to 0.25, and is more preferably 0.15 to 0.20.

When the ratio L2/L1 is 0.12 or more, the mixing of the continuous phase and the core during the production of the toner is suppressed, so that the durability of the toner to the load is likely to be enhanced.

On the other hand, when the ratio L2/L1 is 0.25 or less, the low temperature fixability is likely to be enhanced.

In the toner according to the exemplary embodiment, it is preferable that the discontinuous phase is uniformly dispersed throughout the toner. By dispersing the discontinuous phase with high uniformity, non-uniformity of the function of the discontinuous phase as a filler is suppressed, so that the durability of the toner to the load is likely to be enhanced.

As an index of the dispersibility, an area ratio of the discontinuous phase between the inner and outer regions of the toner in the cross section of the toner. Specifically, when the cross section of the toner is observed, a boundary line having the same shape as a shape of the cross section of the toner and surrounding an area of 50% of the cross-sectional area of the toner is drawn coaxially on the cross section. That is, a boundary line having the same shape as a shape of the cross section of the toner and having an outline smaller than the shape of the cross section of the toner is drawn on the cross-sectional image of the toner to divide a region of the cross section of the toner into a region inside the boundary line and a region outside the boundary line such that the area ratio becomes 1:1. A ratio m1/m2 of an area m1 of the discontinuous phase present inside the boundary line to an area m2 of the discontinuous phase present outside the boundary line is preferably 0.8 to 1.2, and is more preferably 0.9 to 1.1.

Here, a method of measuring each property of the discontinuous phase by observing the cross section of the toner will be described.

The toner particle is embedded with a bisphenol A type liquid epoxy resin and a curing agent, and then produce a cutting sample. Next, a cutting sample is cut at −100° C. using a cutting machine using a diamond knife (for example, LEICA Ultramicrotome, manufactured by Hitachi Technologies) so as to produce a sample for observation. Further, when it is desired to increase a difference in brightness (contrast) described later, the sample for observation may be left in a desiccator under a ruthenium tetraoxide atmosphere to perform staining. In addition, dyeing is determined by the degree of dyeing of a tape left in the desiccator.

The observation sample thus obtained is observed by a scanning transmission electron microscope (STEM). The image is recorded at a magnification at which the cross section of one toner particle falls within the field of view. Regarding the recorded image, image analysis is performed under the condition of 0.010000 μm/pixel using image analysis software (WinROOF manufactured by Mitani Corporation). According to this image analysis, the shape of the cross section of the discontinuous phase is extracted by the difference in brightness (contrast) between the binder resin of the continuous phase (sea) of the toner particle and the binder resin of the discontinuous phase (island) having the core and the coating layer.

Then, a projected area is obtained based on the extracted shape of the cross section of the discontinuous phase. From this projected area, the ratio of the total area of the discontinuous phase to the cross-sectional area of the toner is calculated for each of 100 toners, and the arithmetic mean value thereof is set as the ratio of the area occupied by the discontinuous phase to the cross-sectional area of the toner.

Further the equivalent circle diameter of the discontinuous phase is obtained from the projected area. Note that, the equivalent circle diameter is calculated by Expression "$2\times(\text{projected area}/\pi)^{1/2}$". 100 toners are observed, one discontinuous phase is selected for each toner, the equivalent circle diameter thereof is obtained, and the arithmetic mean value thereof is set as the average equivalent circle diameter L1 of the discontinuous phase.

Further, the shape of the cross section of the core is extracted by the difference in brightness (contrast) between the binder resin of the core and the binder resin of the coating layer. Based on the shape of the cross section of the core, the projected area of the core is obtained, and the equivalent circle diameter of the core is obtained. As in the above L1, 100 toners are observed, one core is selected for each toner, the equivalent circle diameter thereof is obtained, and the arithmetic mean value thereof is set as the average equivalent circle diameter L3 of the core. Then, from the difference between L1 and L3, the average thickness L2 of the coating layer is obtained from the expression "(L1−L3)/2".

Further, in the cross-sectional image, a boundary line having the same shape as a shape of the cross section of the toner and surrounding an area of 50% of the cross-sectional area of the toner is drawn coaxially on the cross section of the toner. The ratio of the area m1 of the discontinuous phase present inside the boundary line to the area m2 of the discontinuous phase present outside the boundary line is calculated for each of 100 toners, and the arithmetic mean value thereof is set as a ratio m1/m2.

Here, the method of forming the structure of the toner according to the exemplary embodiment, that is, the structure including the continuous phase and the discontinuous phase having the core and the coating layer is not particularly limited. For example, as an example, the following method of a coalescence method is exemplified.

First, a resin particle dispersion of the amorphous polyester resin A2 having an unsaturated double bond is prepared. A composite resin particle dispersion having a coating layer containing the vinyl resin B around the core containing the amorphous polyester resin A2 is produced by adding and reacting a vinyl monomer and an initiator to the obtained resin particle dispersion. Since the amorphous polyester resin A2 has the unsaturated double bond, it forms a chemical bond with the vinyl resin B at the interface between the core and the coating layer.

By producing the toner with this composite resin particle dispersion, a resin particle dispersion of the amorphous polyester resin A1 separately produced, and a resin particle dispersion of crystalline polyester resin C by using the coalescence method, a toner having a structure including the continuous phase and the discontinuous phase containing the core and the coating layer is obtained.

Note that, it is considered that it is not easy to obtain the toner having the above-described structure by using a melt-kneading method in which the temperature becomes higher as a resin is melted or a suspension polymerization method in which a resin is dissolved in a solvent.

Further, in the above manufacturing method, the ratio of the area occupied by the discontinuous phase to the cross-sectional area of the toner can be controlled by the additional amount of the composite resin particle dispersion at the time of producing the toner. In addition, the average equivalent circle diameter L1 of the discontinuous phase and the average thickness L2 of the coating layer can be controlled by a particle diameter of amorphous polyester resin A2 in the resin particle dispersion and the additional amount of the vinyl monomer with respect to amorphous polyester resin A2.

Next, each component and the like constituting the toner according to the exemplary embodiment will be described in detail.

The toner according to the exemplary embodiment is configured to preferably include a toner particle and an external additive if necessary.

Toner Particle

The toner particle is configured to include a binder resin and if necessary, a coloring agent, a release agent, and other additives. The toner particle contains a continuous phase containing a binder resin; and a discontinuous phase that is dispersed in the continuous phase, and the discontinuous phase has a core containing the binder resin and a coating layer covering the core and containing the binder resin.

Binder Resin

Examples of the binder resin included in the continuous phase, the core, and the coating layer in the toner particle include vinyl resins formed of homopolymer of monomers such as styrenes (for example, styrene, para-chloro styrene, and α-methyl styrene), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenic unsaturated nitriles (for example, acrylonitrile, and methacrylonitrile), vinyl ethers (for example, vinyl methyl ether, and vinyl isobutyl ether), vinyl ketones (for example, vinyl methyl ketone, vinyl ethyl ketone, and vinyl isopropenyl ketone), and olefins (for example, ethylene, propylene, and butadiene), or copolymers obtained by combining two or more kinds of these monomers.

As the binder resin, there are also exemplified non-vinyl resins such as an epoxy resin, a polyester resin, a polyurethane resin, a polyamide resin, a cellulose resin, a polyether resin, and a modified rosin, a mixture thereof with the above-described vinyl resins, or a graft polymer obtained by polymerizing a vinyl monomer with the coexistence of such non-vinyl resins.

These binder resins may be used alone or in combination of two or more types thereof in each of the continuous phase, core, and coating layer.

Although not particularly limited, in the toner particles according to the exemplary embodiment, it is preferable that the continuous phase contains the amorphous polyester resin A1 and the crystalline polyester resin C, the core contains the amorphous polyester resin A2, and the coating layer contains a vinyl resin.

Examples of the polyester resin include a well-known amorphous polyester resin. As the polyester resin, the crystalline polyester resin may be used in combination with the amorphous polyester resin. Here, the content of the crystalline polyester resin may be used in a range of 2% by weight to 40% by weight (preferably 2% by weight to 20% by weight) with respect to the entire binder resin in the toner.

In addition, "crystallinity" of resin means to have a clear endothermic peak instead of a stepwise endothermic change in differential scanning calorimetry (DSC), and specifically means that the half-width of the endothermic peak at the time of being measured at a temperature elevation rate of 10 (° C./min) is within 10° C.

On the other hand, "amorphous" of the resin means that the half-width exceeds 10° C., a stepwise endothermic change is exhibited, or a clear endothermic peak is not observed.

Amorphous Polyester Resin

Examples of amorphous polyester resins include condensation polymers of polyvalent carboxylic acids and polyhydric alcohols. Among these, as the amorphous polyester resin, a commercial product may be used or synthesized product may be used.

Examples of the polyvalent carboxylic acid include aliphatic dicarboxylic acid (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acid (for example, cyclohexane dicarboxylic acid), aromatic dicarboxylic acid (for example, terephthalic acid, isophthalic acid, phthalic acid, and naphthalene dicarboxylic acid), an anhydride thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, tri- or higher-valent carboxylic acid employing a crosslinked structure or a branched structure may be used in combination together with dicarboxylic acid. Examples of the tri- or higher-valent carboxylic acid include trimellitic acid, pyromellitic acid, an anhydride thereof, or lower alkyl esters (having, for example, 1 to 5 carbon atoms) thereof.

The polyvalent carboxylic acids may be used alone or in combination of two or more types thereof.

Examples of the polyhydric alcohol include aliphatic diol (for example, ethylene glycol, diethylene glycol, triethylene glycol, propylene glycol, butanediol, hexanediol, and neopentyl glycol), alicyclic diol (for example, cyclohexanediol, cyclohexane dimethanol, and hydrogenated bisphenol A), aromatic diol (for example, an ethylene oxide adduct of bisphenol A, and a propylene oxide adduct of bisphenol A). Among these, for example, aromatic diols and alicyclic diols are preferably used, and aromatic diols are more preferably used as the polyhydric alcohol.

As the polyhydric alcohol, a tri- or higher-valent polyhydric alcohol employing a crosslinked structure or a branched structure may be used in combination together with diol. Examples of the tri- or higher-valent polyhydric alcohol include glycerin, trimethylolpropane, and pentaerythritol.

The polyhydric alcohol may be used alone or in combination of two or more types thereof.

The glass-transition temperature Tg of the amorphous polyester resin is preferably in a range of 50° C. to 80° C., and more preferably in a range of 50° C. to 65° C.

The glass-transition temperature is obtained from a DSC curve obtained by differential scanning calorimetry (DSC). More specifically, the glass-transition temperature is obtained from "extrapolated glass transition onset temperature" described in the method of obtaining a glass-transition temperature in JIS K 7121-1987 "testing methods for transition temperatures of plastics".

The weight average molecular weight Mw of the amorphous polyester resin is preferably in a range of 5,000 to 1,000,000, and is more preferably in a range of 7,000 to 500,000.

The number average molecular weight Mn of the amorphous polyester resin is preferably in a range of 2,000 to 100,000.

The molecular weight distribution Mw/Mn of the amorphous polyester resin is preferably in a range of 1.5 to 100, and is more preferably in a range of 2 to 60.

The weight average molecular weight and the number average molecular weight are measured by gel permeation chromatography (GPC). The molecular weight measurement by GPC is performed using GPC & HLC-8120 GPC, manufactured by Tosoh Corporation as a measuring device, Colunm TSK gel Super HM-M (15 cm), manufactured by Tosoh Corporation, and a THF solvent. The weight average molecular weight and the number average molecular weight are calculated by using a molecular weight calibration curve plotted from a monodisperse polystyrene standard sample from the results of the foregoing measurement.

A known preparing method is used to produce the amorphous polyester resin. Specific examples thereof include a method of conducting a reaction at a polymerization temperature set to be in a range of 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

Crystalline Polyester Resin

Examples of the crystalline polyester resin include a condensation polymer of polyvalent carboxylic acid and polyhydric alcohol. Among these, as the crystalline polyester resin, a commercial product may be used or synthesized product may be used.

Here, in order to easily form a crystalline structure, the crystalline polyester resin is preferably a polycondensate using a polymerizable monomer having a linear aliphatic group rather than a polymerizable monomer having an aromatic group.

Examples of the polyvalent carboxylic acid include aliphatic dicarboxylic acid (such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acid (such as phthalic acid, isophthalic acid, terephthalic acid, dibasic acids such as naphthalene-2,6-dicarboxylic acid), and anhydrides thereof or lower alkyl esters (having, for example, from 1 to 5 carbon atoms) thereof.

As the polyvalent carboxylic acid, tri- or higher-valent carboxylic acid employing a crosslinked structure or a branched structure may be used in combination together with dicarboxylic acid. Examples of trivalent carboxylic acids include aromatic carboxylic acid (such as 1,2,3-benzenetricarboxylic acid, 1,2,4-benzenetricarboxylic acid, and 1,2,4-naphthalenetricarboxylic acid), and anhydrides thereof or lower alkyl esters (having, for example, from 1 to 5 carbon atoms) thereof.

As the polyvalent carboxylic acid, a dicarboxylic acid having a sulfonic acid group and a dicarboxylic acid having an ethylenic double bond may be used in combination with these dicarboxylic acids. The polyvalent carboxylic acids may be used alone or in combination of two or more types thereof.

Examples of polyhydric alcohols include aliphatic diols (for example, straight-chain aliphatic diols having 7 to 20 carbon atoms in the main chain portion). Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosan decanediol. Among these, 1,8-octanediol, 1,9-nonanediol, and 1,10-decanediol are preferable as the aliphatic diol. As the polyhydric alcohol, a tri- or higher-valent alcohol employing a crosslinked structure or a branched structure may be used in combination together with diol. Examples of the tri- or higher-valent alcohols include glycerin, trimethylolethane, trimethylolpropane, and pentaerythritol. The polyhydric alcohol may be used alone or in combination of two or more types thereof.

Here, the polyhydric alcohol preferably has an aliphatic diol content of 80% by mol or more, and more preferably 90% by mol or more.

The melting temperature of the crystalline polyester resin is preferably 50° C. to 100° C., is more preferably 55° C. to 90° C., and is still more preferably 60° C. to 85° C.

Note that, the melting temperature is obtained from a DSC curve obtained by differential scanning calorimetry (DSC), and specifically obtained from "melting peak temperature" described in the method of obtaining a melting temperature in JIS K 7121-1987 "testing methods for transition temperatures of plastics".

The weight average molecular weight Mw of the crystalline polyester resin is preferably 6,000 to 35,000.

Similar to the amorphous polyester resin, the crystalline polyester resin is obtained by a known production method, for example.

Vinyl Resin

The vinyl resin is a polymer obtained by polymerizing at least a vinyl monomer which is a monomer having a vinyl group ($CH_2{=}C(-R^{B1})-$; here, $R^{B1}$ represents a hydrogen atom or a methyl group).

In the present specification, "(meth) acrylic" is an expression including both "acrylic" and "methacrylic".

Examples of the vinyl monomer include (meth)acrylic acid and (meth)acrylic acid ester. Examples of the (meth) acrylic acid ester include (meth)acrylic acid alkyl ester (such as methyl (meth)acrylate, ethyl (meth)acrylate, n-propyl (meth)acrylate, n-butyl (meth)acrylate, n-pentyl (meth)acrylate, n-hexyl (meth)acrylate, n-heptyl (meth)acrylate, n-octyl (meth)acrylate, n-decyl (meth)acrylate, n-dodecyl (meth) acrylate, n-lauryl (meth)acrylate, n-tetradecyl (meth) acrylate, n-hexadecyl (meth)acrylate, n-octadecyl (meth) acrylate, isopropyl (meth)acrylate, isobutyl (meth)acrylate, t-butyl (meth)acrylate, isopentyl (meth)acrylate, amyl (meth)acrylate, neopentyl (meth)acrylate, isohexyl (meth) acrylate, isoheptyl (meth)acrylate, isooctyl (meth)acrylate, 2-ethyl hexyl (meth)acrylate, cyclohexyl (meth)acrylate, and t-butylcyclohexyl (meth)acrylate), (meth)acrylic acid aryl ester (such as phenyl (meth)acrylate, biphenyl (meth) acrylate, diphenylethyl (meth)acrylate, t-butyl phenyl (meth)acrylate, and terphenyl (meth)acrylate), dimethyl aminoethyl (meth)acrylate, diethyl aminoethyl (meth)acrylate, methoxyethyl (meth)acrylate, 2-hydroxyethyl (meth) acrylate, β-carboxyethyl (meth)acrylate, (meth)acrylamide, styrene, alkyl substituted styrene (such as α-methyl styrene, 2-methyl styrene, 3-methyl styrene, 4-methyl styrene, 2-ethyl styrene, 3-ethyl styrene, and 4-ethyl styrene), halogen substituted styrene (such as 2-chlorostyrene, 3-chlorostyrene, and 4-chlorostyrene), and vinyl naphthalene.

Further, a vinyl monomer having two or more functions (preferably, a polyfunctional vinyl monomer having two or more vinyl groups) is also used.

Examples of the bifunctional vinyl monomer include divinyl benzene, divinyl naphthalene, a di(meth)acrylate compound (such as diethylene glycol di(meth)acrylate, methylene bis(meth)acrylamide, decanediol diacrylate, and glycidyl (meth)acrylate), polyester type di(meth)acrylate, methacrylic acid 2-([1'-methyl propylideneamino] carboxyamino) ethyl.

Examples of the trifunctional or higher vinyl monomer include a tri(meth)acrylate compound (such as pentaerythritol tri(meth)acrylate, trimethylolethane tri(meth)acrylate, and trimethylolpropane tri(meth) acrylate), a tetra(meth) acrylate compound (such as pentaerythritol tetra(meth)acrylate, and oligoester (meth)acrylate), 2,2-bis(4-methacryloxy, polyethoxyphenyl) propane, diallyl phthalate, triallyl cyanurate, triallyl isocyanurate, triallyl trimellitate, and diaryl chlorendate.

Note that, as the vinyl monomer, (meth)acrylic esters having an alkyl group having 2 to 14 carbon atoms (preferably 2 to 10 carbon atoms, and more preferably 3 to 8 carbon atoms) is preferable from the viewpoint of fixability.

The vinyl monomer may be used alone or in combination of two or more types thereof.

In a case where the vinyl monomer is contained in the coating layer, the glass-transition temperature Tg is preferably lower than the fixing temperature (that is, setting temperature at the time of fixing in the image forming apparatus).

A content of the binder resin is, for example, preferably from 40% by weight to 95% by weight, is more preferably from 50% by weight to 90% by weight, and is still more preferably from 60% by weight to 85% by weight, with respect to the entire toner particles.

Coloring Agent

Examples of the coloring agent include various types of pigments such as carbon black, chrome yellow, Hansa yellow, benzidine yellow, threne yellow, quinoline yellow, pigment yellow, Pennanent Orange GTR, Pyrazolone Orange, Vulcan Orange, Watch Young Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite Green Oxalate, or various types of dyes such as acridine dye, xanthene dye, azo dye, benzoquinone dye, azine dye, anthraquinone dye, thioindigo dye, dioxazine dye, thiazine dye, azomethine dye, indigo dye, phthalocyanine dye, aniline black dye, polymethine dye, triphenylmethane dye, diphenylmethane dye, and thiazole dye.

In addition, a white pigment may be included as a coloring agent. Examples of the white pigment include titanium oxide (such as a titanium oxide particle having an anatase type and a titanium oxide particle having a rutile type), barium sulfate, zinc oxide, and calcium carbonate. Among them, titanium oxide is preferable as the white pigment.

In addition, a brilliant pigment may be included as a coloring agent. Examples of the brilliant pigment include pearl pigment powder, aluminum powder, metal powder such as stainless steel powder, metal flakes, glass beads, glass flakes, mica, and micaceous iron oxide.

The coloring agent may be used alone or two or more kinds thereof may be used in combination.

As the coloring agent, a surface-treated coloring agent may be used if necessary, and it may be used together with a dispersing agent. Further, a plurality of kinds of the coloring agents may be used in combination.

The content of the coloring agent is preferably 1% by weight to 30% by weight, and is more preferably 3% by weight to 15% by weight with respect to the entire toner particles.

Release agent Examples of the release agent include hydrocarbon waxes; natural waxes such as carnauba wax, rice wax, and candelilla wax; synthetic waxes or mineral or petroleum waxes such as montan wax: and ester waxes such as fatty acid esters and montanic acid esters. However, the release agent is not limited to the above examples.

The melting temperature of the release agent is preferably in a range of 50° C. to 110° C., and is further preferably in a range of 60° C. to 100° C.

Note that, the melting temperature is obtained from a DSC curve obtained by differential scanning calorimetry (DSC), and specifically obtained from "melting peak temperature" described in the method of obtaining a melting temperature in JIS K 7121-1987 "testing methods for transition temperatures of plastics".

The content of the release agent is preferably 1% by weight to 20% by weight, and is more preferably 5% by weight to 15% by weight with respect to the entire toner particles.

Other Additives

Examples of other additives include well-known additives such as a magnetic material, an electrostatic charge control agent, and an inorganic powder. These additives are included in the toner particles as internal additives.

Properties of Toner Particle

The toner particles may be toner particles having a single-layer structure, or toner particles having a so-called core and shell structure composed of a core (so-called core particle) and a coating layer (so-called shell layer) coated on the core. Here, the toner particles having a core and shell structure is preferably composed of, for example, a core containing a binder resin, and if necessary, other additives such as a coloring agent and a release agent and a coating layer containing a binder resin.

The volume average particle diameter D50v of the toner particle is preferably 2 μm to 10 m, and is more preferably 4 m to 8 μm.

Various average particle diameters of the toner particles and various particle diameter distribution indices are measured using Coulter Multisizer II (manufactured by Beckman Coulter, Inc.), and the electrolytic solution is measured using ISOTON-II (manufactured by Beckman Coulter, Inc.).

In the measurement, a measurement sample in a range of 0.5 mg to 50 mg is added to 2 ml of a 5% by weight aqueous solution of surfactant (preferably sodium alkyl benzene sulfonate) as a dispersing agent. The obtained material is added to the electrolyte in a range of 100 ml to 150 ml.

The electrolyte in which the sample is suspended is subjected to a dispersion treatment using an ultrasonic disperser for one minute, and a particle diameter distribution of particles having a particle diameter of from 2 μm to 60 μm is measured by a Coulter Multisizer II using an aperture having an aperture diameter of 100 μm. 50,000 particles are sampled.

Cumulative distributions by volume and by number are drawn from the side of the smallest diameter with respect to particle diameter ranges (so-called channels) separated based on the measured particle diameter distribution. The particle diameter corresponding to the cumulative percentage of 16% is defined as that corresponding to a volume average particle diameter D6v and a number average particle diameter D16p, while the particle diameter corresponding to the cumulative percentage of 50% is defined as that corresponding to a volume average particle diameter D50v and a number average particle diameter D50p. Furthermore, the particle diameter corresponding to the cumulative percentage of 84% is defined as that corresponding to a volume average particle diameter D84v and a number average particle diameter D84p.

Using these, a volume particle diameter distribution index (GSDv) is calculated as $(D84v/D16v)^{1/2}$, while a number particle diameter distribution index (GSDp) is calculated as $(D84p/D16p)^{1/2}$.

The average circularity of the toner particles is preferably 0.94 to 1.00, and is more preferably 0.95 to 0.98.

The average circularity of the toner particles is calculated by (circumference length of equivalent circle)/(circumference length) [(circumference length of circle having the same projected area as that of particle image)/(circumference length of particle projected image)]. Specifically, the aforementioned value is measured by using the following method.

The average circularity of the toner particles is calculated by using a flow particle image analyzer (FPIA-3,000 manufactured by Sysmex Corporation) which first, suctions and collects the toner particles to be measured so as to form flake flow, then captures a particle image as a static image by instantaneously emitting strobe light, and then performs image analysis of the obtained particle image. 3,500 particles are sampled at the time of calculating the average circularity.

In a case where the toner contains an external additive, the developer containing the toner to be measured is dispersed in the water containing a surfactant, and then the water is subjected to an ultrasonic treatment so as to obtain the toner particles in which the external additive is removed.

External Additive

Examples of the external additive include an inorganic particle. Examples of the inorganic particle include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

The surface of the inorganic particle as the external additive may be subjected to a hydrophobization treatment. The hydrophobization treatment is performed, for example, by immersing inorganic particles in a hydrophobization treating agent. The hydrophobization treating agent is not particularly limited, and examples thereof include a silane coupling agent, a silicone oil, a titanate coupling agent, and an aluminum coupling agent. These may be used alone or two or more kinds thereof may be used in combination.

The amount of the hydrophobization treating agent is generally, for example, 1 part by weight to 10 parts by weight respect to 100 parts by weight of the inorganic particles.

Examples of the external additive include a resin particle (such as polystyrene, polymethyl methacrylate (PMMA), and a melamine resin), a cleaning agent (such as a metal salt of higher fatty acid represented by zinc stearate, and a particle of a fluorine polymer).

The content of the external additive is preferably 0.01% by weight to 5% by weight, and is more preferably 0.01% by weight to 2.0% by weight with respect to the entire toner particles.

Method of Producing Toner

Next, a method of producing toner of the exemplary embodiment will be described. The toner according to the exemplary embodiment can be obtained by externally adding an external additive to the toner particle after producing the toner particle.

The toner particles may be produced by using any one of a drying method (for example, a kneading and pulverizing method) and a wetting method (for example, an aggregation and coalescence method, a suspension polymerization method, and a dissolution suspension method). The preparing method of the toner particles is not particularly limited, and well-known method may be employed.

Among them, the toner particles may be obtained by using the aggregation and coalescence method.

Specifically, for example, in a case where the toner particles are produced by using the aggregation and coalescence method, the toner particles are produced through the following steps. The steps include a step (a resin particle dispersion preparing step) of preparing a resin particle dispersion in which resin particles constituting the binder resin are dispersed, a step (an aggregated particle forming step) of forming aggregated particles by aggregating the resin particles (other particles if necessary), in the resin particle dispersion (in the dispersion in which other particle dispersions are mixed, if necessary); and a step (a coalescence step) of forming a toner particle by coalescing aggregated particles by heating an aggregated particle dispersion in which aggregated particles are dispersed so as to prepare a toner particle.

Hereinafter, the respective steps will be described in detail.

In the following description, a method of obtaining toner particles including the coloring agent and the release agent will be described: however, the coloring agent and the release agent are used if necessary. Other additives other than the coloring agent and the release agent may also be used.

Resin Particle Dispersion Preparing Step

First, a resin particle dispersion in which the resin particles corresponds to the binder resins are dispersed, a coloring agent particle dispersion in which coloring agent particles are dispersed, and a release agent particle dispersion in which the release agent particles are dispersed are prepared, for example.

Here, the resin particle dispersion is, for example, produced by dispersing the resin particles in a dispersion medium with a surfactant.

An aqueous medium is used, for example, as the dispersion medium used in the resin particle dispersion.

Examples of the aqueous medium include water such as distilled water, ion exchange water, or the like, alcohols, and the like. The medium may be used alone or two or more kinds thereof may be used in combination.

Examples of the surfactant include anionic surfactants such as sulfate, sulfonate, phosphate, and soap anionic surfactants; cationic surfactants such as amine salt and quaternary ammonium salt cationic surfactants; and nonionic surfactants such as polyethylene glycol, alkyl phenol ethylene oxide adduct, and polyhydric alcohol. Among them, anionic surfactants and cationic surfactants are particularly preferable. Nonionic surfactants may be used in combination with anionic surfactants or cationic surfactants.

The surfactants may be used alone or two or more kinds thereof may be used in combination.

In the resin particle dispersion, as a method of dispersing the resin particles in the dispersion medium, a common dispersing method by using, for example, a rotary shearing-type homogenizer, a ball mill having media, a sand mill, or a Dyno mill is exemplified. Further, depending on the kinds of the resin particles, the resin particles may be dispersed in the resin particle dispersion by using, for example, a phase inversion emulsification method.

The phase inversion emulsification method is a method of dispersing a resin in an aqueous medium in a particle form by dissolving a resin to be dispersed in a hydrophobic organic solvent in which the resin is soluble, conducting neutralization by adding a base to an organic continuous phase (O phase), and performing inversion (so called phase inversion) of the resin from W/O to O/W to make discontinuous phase by adding an aqueous medium (W phase).

The volume average particle diameter of the resin particles dispersed in the resin particle dispersion is, for example, preferably from 0.01 μm to 1 μm, is more preferably from 0.08 μm to 0.8 μm, and is still more preferably from 0.1 μm to 0.6 μm.

Regarding the volume average particle diameter of the resin particles, a cumulative distribution by volume is drawn from the side of the smallest diameter with respect to particle diameter ranges (so-called channels) separated using the particle diameter distribution obtained by the measurement of a laser diffraction-type particle diameter distribution measuring device (for example, manufactured by Horiba, Ltd., LA-700), and a particle diameter corresponding to the cumulative percentage of 50% with respect to the entire particles is set as a volume average particle diameter D50v. Note that, the volume average particle diameter of the particles in other dispersion liquids is also measured in the same manner.

The content of the resin particles contained in the resin particle dispersion is preferably from 5% by weight to 50% by weight, and is more preferably from 10% by weight to 40% by weight.

Note that, the coloring agent particle dispersion and the release agent particle dispersion are also produced in the same manner as in the case of the resin particle dispersion. That is, the volume average particle diameter of the particles in the resin particle dispersion, dispersion medium, the dispersing method, and the content of the particles are the same as those in the coloring agent particles dispersed in the coloring agent particle dispersion and the release agent particles dispersed in the release agent particle dispersion.

In the exemplary embodiment, in the resin particle dispersion preparing step, it is preferable to produce a composite resin particle dispersion having a coating layer containing the binder resin (iii) (more preferably the vinyl resin B) around the core containing the binder resin (ii) (more preferably the amorphous polyester resin A2).

For example, the composite resin particle dispersion having a coating layer containing the vinyl resin B around the core containing the amorphous polyester resin A2 can be produced by preparing the resin particle dispersion of amorphous polyester resin A2 having unsaturated double bonds, and adding and reacting a vinyl monomer and an initiator to the obtained resin particle dispersion.

Further, it is preferable to prepare a resin particle dispersion (more preferably a resin particle dispersion containing amorphous polyester resin A1 and a resin particle dispersion containing crystalline polyester resin C) for the continuous phase containing the binder resin (i) separately from the composite resin particle dispersion.

Aggregated Particle Forming Step

Next, the resin particle dispersion, the coloring agent particle dispersion, and the release agent particle dispersion are mixed with each other. In addition, in the mixed dispersion, the resin particle, the coloring agent particle, and the release agent particle are heteroaggregated, and thereby an aggregated particle which has a diameter close to a targeted diameter of the toner particle and contains the resin particle, the coloring agent particle, and the release agent particle is formed.

In the exemplary embodiment, as a resin particle dispersion, it is preferable to obtain a toner having a structure including a continuous phase and a discontinuous phase having a core and a coating layer by using the above-mentioned composite resin particle dispersion and the resin particle dispersion for the continuous phase containing the binder resin (i).

Specifically, for example, an aggregating agent is added to the mixed dispersion and a pH of the mixed dispersion is adjusted to be acidic (for example, the pH is from 2 to 5). If necessary, a dispersion stabilizer is added. Then, the mixed dispersion is heated at a temperature close to a glass-transition temperature of the resin particles (specifically, for example, in a range of glass-transition temperature of −30° C. to glass-transition temperature of −10° C. of the resin particles) to aggregate the particles dispersed in the mixed dispersion, thereby forming the aggregated particles.

In the aggregated particle forming step, for example, the aggregating agent may be added at room temperature (for example, 25° C.) while stirring of the mixed dispersion using a rotary shearing-type homogenizer, the pH of the mixed dispersion may be adjusted to be acidic (for example, the pH is from 2 to 5), a dispersion stabilizer may be added if necessary, and then the heating may be performed.

Examples of the aggregating agent include a surfactant having an opposite polarity to the polarity of the surfactant used as the dispersing agent to be added to the mixed dispersion, an inorganic metal salt, a divalent or more metal complex. Particularly, when a metal complex is used as the aggregating agent, the amount of the surfactant used is reduced and charging properties are improved. An additive for forming a complex or a similar bond with metal ions as the aggregating agent may be used, if necessary. A chelating agent is suitably used as the additive.

Examples of the inorganic metal salt include metal salt such as calcium chloride, calcium nitrate, barium chloride, magnesium chloride, zinc chloride, aluminum chloride, and aluminum sulfate, and an inorganic metal salt polymer such as poly aluminum chloride, poly aluminum hydroxide, and calcium polysulfide.

As the chelating agent, an aqueous chelating agent may be used. Examples of the chelating agent include oxycarboxylic acid such as tartaric acid, citric acid, and gluconic acid, iminodiacetic acid (IDA), nitrilotriacetic acid (NTA), and ethylenediaminetetraacetic acid (EDTA).

The additive amount of the chelating agent is, for example, preferably in a range of 0.01 parts by weight to 5.0 parts by weight, and is more preferably equal to or greater than 0.1 parts by weight and less than 3.0 parts by weight, with respect to 100 parts by weight of resin particle.

Coalescence Step

Next, the aggregated particle dispersion in which the aggregated particles are dispersed is heated at, for example, a temperature that is equal to or higher than the glass-transition temperature of the resin particles (for example, a temperature that is higher than the glass-transition temperature of the resin particles by 10° C. to 30° C.) to perform the coalesce on the aggregated particles and form toner particles.

The toner particles are obtained through the foregoing steps.

Note that, the toner particles may be obtained through a step of forming a second aggregated particles in such a manner that an aggregated particle dispersion in which the aggregated particles are dispersed is obtained, the aggregated particle dispersion and a resin particle dispersion in which resin particles are dispersed are mixed, and the mixtures are aggregated so as to attach the resin particle on the surface of the aggregated particle, and a step of forming the toner particles having a core and shell structure by heating a second aggregated particle dispersion in which the second aggregated particles are dispersed, and coalescing the second aggregated particles.

Here, after the coalescence step ends, the toner particles formed in the solution are subjected to a washing step, a solid-liquid separation step, and a drying step, that are well known, and thus dry toner particles are obtained.

In the washing step, displacement washing using ion exchange water may be sufficiently performed from the viewpoint of charging properties. In addition, the solid-liquid separation step is not particularly limited, but suction filtration, pressure filtration, or the like is preferably performed from the viewpoint of productivity. The method of the drying step is also not particularly limited, but freeze drying, airflow drying, fluidized drying, vibration-type fluidized drying, or the like may be performed from the viewpoint of productivity.

The toner according to the exemplary embodiment is produced, for example, by adding an external additive to the obtained toner particles in the dry state and mixing them.

The mixing may be performed by using, for example, a V blender, a Henschel mixer, a Loedige mixer, or the like. Furthermore, if necessary, coarse particles of the toner may be removed by using a vibration sieving machine, a wind classifier, or the like.

Electrostatic Charge Image Developer

The electrostatic charge image developer according to the exemplary embodiment contains at least the toner according to the exemplary embodiment.

The electrostatic charge image developer according to the exemplary embodiment may be a one-component developer containing only the toner according to the exemplary embodiment, or may be a two-component developer in which the toner and the carrier are mixed with each other.

The carrier is not particularly limited, and a well-known carrier may be used. Examples of the carrier include a coating carrier in which the surface of a core formed of magnetic particle is coated with a coating resin: a magnetic particle dispersion-type carrier in which magnetic particles are dispersed and distributed in a matrix resin; and a resin impregnated-type carrier in which a resin is impregnated into porous magnetic particles.

Note that, the magnetic particle dispersion-type carrier and the resin impregnated-type carrier may be a carrier in which the forming particle of the aforementioned carrier is set as a core and the core is coated with the coating resin.

Examples of the magnetic particle include a magnetic metal such as iron, nickel, and cobalt, and a magnetic oxide such as ferrite, and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, a straight silicone resin formed by containing an organosiloxane bond, or the modified products thereof, a fluororesin, polyester, polycarbonate, a phenol resin, and an epoxy resin. The coating resin and the matrix resin may contain other additives such as conductive particles.

Examples of the conductive particle include metal such as gold, silver, and copper, and particles such as carbon black, titanium oxide, zinc oxide, tin oxide, barium sulfate, aluminum borate, and potassium titanate.

Here, in order to coat the surface of the core with the coating resin, a method of coating the surface with a coating layer forming solution in which the coating resin, and various additives if necessary are dissolved in a proper solvent is used. The solvent is not particularly limited as long as a solvent is selected in consideration of a coating resin to be used and coating suitability.

Specific examples of the resin coating method include a dipping method of dipping the core into the coating layer forming solution, a spray method of spraying the coating layer forming solution onto the surface of the core, a fluid-bed method of spraying the coating layer forming solution to the core in a state of being floated by the fluid air, and a kneader coating method of mixing the core of the carrier with the coating layer forming solution and removing a solvent in the kneader coater.

The mixing ratio (mass ratio) of toner to carrier in the two-component developer is preferably toner:carrier=1:100 to 30:100, and is more preferably 3:100 to 20:100.

Image Forming Apparatus and Image-Forming Method

An image forming apparatus and an image forming method according to this exemplary embodiment will be described.

The image forming apparatus according to the exemplary embodiment is provided with an image holding member, a charging unit that charges the surface of the image holding member, an electrostatic charge image forming unit that forms an electrostatic charge image on the charged surface of the image holding member, a developing unit that accommodates an electrostatic charge image developer, and develops the electrostatic charge image formed on the surface of the image holding member as a toner image by using the electrostatic charge image developer, a transfer unit that transfers the toner image formed on the surface of the image holding member to a surface of a recording medium, and a fixing unit that fixes the toner image transferred onto the surface of the recording medium. In addition, the electrostatic charge image developer according to the exemplary embodiment is used as the electrostatic charge image developer.

In the image forming apparatus according to the exemplary embodiment, an image forming method (the image forming method according to the exemplary embodiment) including a step of charging a surface of an image holding member, a step of forming an electrostatic charge image on the charged surface of the image holding member, a step of developing an electrostatic charge image formed on the surface of the image holding member as a toner image with the electrostatic charge image developer according to the exemplary embodiment, a step of transferring the toner image formed on the surface of the image holding member to a surface of a recording medium, and a step of fixing the toner image transferred to the surface of the recording medium is performed.

As the image forming apparatus according to the exemplary embodiment, well-known image forming apparatuses such as an apparatus including a direct-transfer type apparatus that directly transfers the toner image formed on the surface of the image holding member to the recording medium; an intermediate transfer type apparatus that primarily transfers the toner image formed on the surface of the image holding member to a surface of an intermediate transfer body, and secondarily transfers the toner image transferred to the surface of the intermediate transfer body to the surface of the recording medium; an apparatus a cleaning unit that cleans the surface of the image holding member before being charged and after transferring the toner image; and an apparatus includes an erasing unit that erases charges by irradiating the surface of the image holding member with erasing light before being charged and after transferring the toner image.

In a case where the intermediate transfer type apparatus is used, the transfer unit is configured to include an intermediate transfer body that transfers the toner image to the surface, a first transfer unit that primarily transfers the toner image formed on the surface of the image holding member to the surface of the intermediate transfer body, and a second transfer unit that secondarily transfers the toner image formed on the surface of the intermediate transfer body to the surface of the recording medium.

In the image forming apparatus according to the exemplary embodiment, for example, a unit including the developing unit may be a cartridge structure (process cartridge) detachable from the image forming apparatus. As a process cartridge, for example, a process cartridge including the developing unit accommodating the electrostatic charge image developer according to the exemplary embodiment is preferably used.

Hereinafter, an example of the image forming apparatus according to the exemplary embodiment will be described. However, the process cartridge is not limited thereto. Major parts shown in the drawing will be described, but descriptions of other parts will be omitted.

Figure 2:
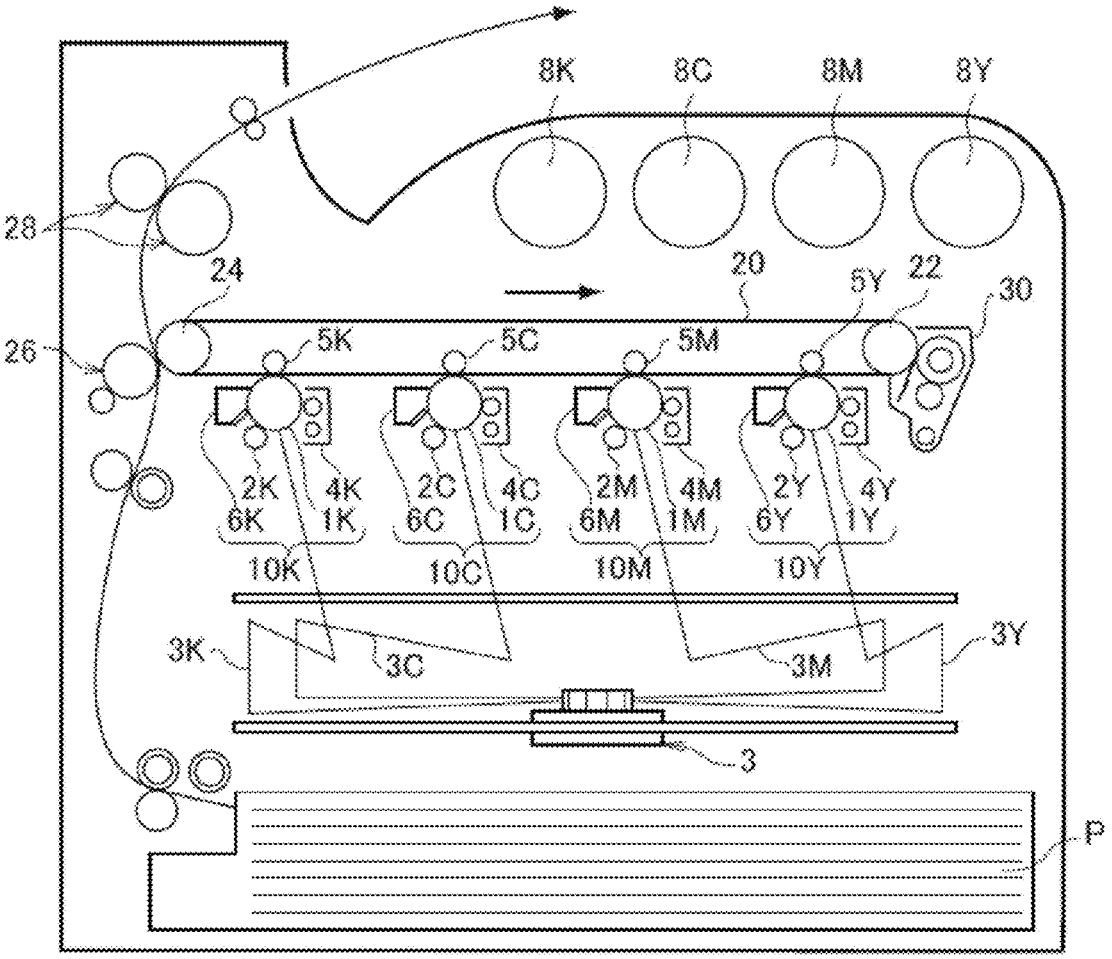
FIG. 2 is a configuration diagram illustrating an example of an image forming apparatus according to the exemplary embodiment.

FIG. 2 is a configuration diagram illustrating an image forming apparatus according to the exemplary embodiment.

The image forming apparatus as illustrated in FIG. 2 is provided with electrophotographic first to fourth image forming units 10Y, 10M, 10C, and 10K (image forming means) that output an image of each color of yellow (Y), magenta (M), cyan (C), and black (K) based on color separated image data. These image forming units (hereinafter, referred to simply as "units" in some cases) 10Y, 10M, 10C, and 10K are arranged in parallel in the horizontal direction with a predetermined distance therebetween. Note that, these units 10Y, 10M, 10C, and 10K may be a process cartridge which is attached to and detached from the image forming apparatus.

On the upper side of the respective units 10Y, 10M, 10C, and 10K in the drawing, an intermediate transfer belt 20 as an intermediate transfer body is extended through the respective units. The intermediate transfer belt 20 is wound around a drive roll 22 and a support roll 24 in contact with the inner surface of the intermediate transfer belt 20, which are spaced apart from each other in the left to right direction in the drawing, and travels in the direction toward the first unit 10Y to the fourth unit 10K. A force is applied to the support roll 24 in a direction away from the drive roll 22 by a spring or the like (not shown), and a tension is applied to the intermediate transfer belt 20 wound around both. An intermediate transfer body cleaning device 30 is provided on the side surface of the image holding member of the intermediate transfer belt 20 so as to face the drive roll 22.

In addition, the toner including four color toners of yellow, magenta, cyan, and black contained in toner cartridges 8Y, 8M, 8C, and 8K in the developing machines (developing unit) 4Y, 4M, 4C, and 4K of the respective units 10Y, 10M, 10C, and 10K is supplied.

Since the first to fourth units 10Y, 10M, 10C, and 10K have the same configuration, here, the first unit 10Y for forming a yellow image disposed on the upstream side in the traveling direction of the intermediate transfer belt will be described as a representative. By denoting reference numerals with magenta (M), cyan (C), and black (K) instead of yellow (Y) to the same portions as those in the first unit 10Y, description of the second to fourth units 10M, 10C, and 10K will be made omitted.

The first unit 10Y includes a photosensitive body 1Y which functions as an image holding member. Around the photosensitive body 1Y, a charging roll (an example of the charging unit) 2Y that charges the surface of the photosensitive body 1Y to a predetermined potential, an exposure device (an example of the electrostatic charge image forming unit) 3 that forms an electrostatic charge image by exposing the charged surface with a laser beam 3Y based on a color separated image signal, a developing machine (an example of the developing unit) 4Y that develops an electrostatic charge image by supplying toner charged to the electrostatic charge image, a first transfer roll 5Y (an example of the first transfer unit) that transfers the developed toner image onto the intermediate transfer belt 20, and a photosensitive body cleaning device (an example of the cleaning unit) 6Y that removes the toner remaining on the surface of the photosensitive body 1Y after first transfer are arranged in order.

The first transfer roll 5Y is disposed on the inner side of the intermediate transfer belt 20, and is provided at a position facing the photosensitive body 1Y. Further, a bias power supply (not shown) for applying a first transfer bias is connected to each of the first transfer rolls 5Y, 5M, 5C, and 5K. Each bias power supply varies the transfer bias applied to each first transfer roll under the control of a control unit (not shown).

Hereinafter, an operation of forming a yellow image in the first unit 10Y will be described.

First, prior to the operation, the surface of the photosensitive body 1Y is charged to a potential of −600 V to −800 V by the charging roll 2Y.

The photosensitive body 1Y is formed by laminating a photosensitive layer on a conductive (for example, volume resistivity at 20° C.: $1\times10^6$ Ωcm or less) substrate. This photosensitive layer generally has high resistance (resistance of general resin), but has the property that the specific resistance of the portion irradiated with the laser beam changes when the laser beam 3Y is irradiated. Therefore, the laser beam 3Y is output to the surface of the charged photosensitive body 1Y through the exposure device 3 in accordance with the image data for yellow sent from the control unit (not shown). The laser beam 3Y is applied to the photosensitive layer on the surface of the photosensitive body 1Y, and thereby, an electrostatic charge image of a yellow image pattern is formed on the surface of the photosensitive body 1Y.

The electrostatic charge image is an image formed on the surface of the photosensitive body 1Y by charging, and is a so-called negative latent image formed in such a manner that the specific resistance of the irradiated portion of the photosensitive layer is reduced by the laser beam 3Y, and the electric charge charged on the surface of the photosensitive body 1Y flows, and the charge of the portion with which the laser beam 3Y is not irradiated remains.

The electrostatic charge image formed on the photosensitive body 1Y is rotated to a predetermined development position as the photosensitive body 1Y travels. Then, at this development position, the electrostatic charge image on the photosensitive body 1Y is made visible (developed image) as a toner image by the developing machine 4Y.

In the developing machine 4Y, for example, an electrostatic charge image developer containing at least a yellow toner and a carrier is accommodated. The yellow toner is frictionally charged by being stirred inside the developing machine 4Y, and is held on a developer roll (an example of the developer holding body) with a charge of the same polarity (negative polarity) as the charged electric charge on the photosensitive body 1Y. Then, as the surface of the photosensitive body 1Y passes through the developing machine 4Y, the yellow toner is electrostatically attached to a discharged latent image portion on the surface of the photosensitive body 1Y, and the latent image is developed by the yellow toner. The photosensitive body 1Y on which a yellow toner image is formed is subsequently traveled at a predetermined speed, and the toner image developed on the photosensitive body 1Y is transported to a predetermined first transfer position.

When the yellow toner image on the photosensitive body 1Y is transported to the first transfer, the first transfer bias is applied to the first transfer roll 5Y, the electrostatic force from the photosensitive body 1Y toward the first transfer roll 5Y acts on the toner image, and the toner image on the photosensitive body 1Y is transferred onto the intermediate transfer belt 20. The transfer bias applied at this time is (+) polarity opposite to polarity (−) of the toner, and for example, in the first unit 10Y, it is controlled to +10 μA by the control unit (not shown).

On the other hand, the toner remaining on the photosensitive body 1Y is removed and collected by a photosensitive body cleaning device 6Y.

Further, the first transfer bias applied to the first transfer rolls 5M, 5C, and 5K after a second unit 10M is also controlled according to the first unit.

In this way, the intermediate transfer belt 20 to which the yellow toner image is transferred in the first unit 10Y is sequentially transported through the second to fourth units 10M, 10C, and 10K, and the toner images of the respective colors are superimposed and transferred in multiples.

The intermediate transfer belt 20 on which toner images of four colors are multiply transferred through the first to fourth units leads to a second transfer portion configured to include the intermediate transfer belt 20 and the support roll 24 in contact with the inner surface of the intermediate transfer belt and a second transfer roll (an example of a second transfer means) 26 disposed on the image holding surface side of the intermediate transfer belt 20. On the other hand, the recording sheet (an example of the recording medium) P is fed at a predetermined timing to the gap where the second transfer roll 26 and the intermediate transfer belt 20 are in contact with each other via a supply mechanism, and the second transfer bias is applied to the support roll 24. The transfer bias applied at this time is the same polarity (−) as the polarity (−) of the toner, and the electrostatic force from the intermediate transfer belt 20 to the recording sheet P acts on the toner image such that the toner image is transferred onto the recording sheet P on the intermediate transfer belt 20. The second transfer bias at this time is determined according to the resistance detected by the resistance detection unit (not shown) that detects the resistance of the second transfer portion, and is voltage controlled.

Thereafter, the recording sheet P is sent to the press-contact portion (nip portion) of a pair of fixing rolls in the fixing device (an example of the fixing unit) 28, the toner image is fixed on the recording sheet P, and a fixed image is formed.

Examples of the recording sheet P to which the toner image is transferred include plain paper used for an electrophotographic copying machine, a printer or the like. As the recording medium, in addition to the recording sheet P, an OHP sheet or the like may be exemplified.

In order to further improve the smoothness of the image surface after fixation, the surface of the recording sheet P is also preferably smooth, for example, coated paper in which the surface of plain paper is coated with resin or the like and art paper for printing are preferably used.

The recording sheet P for which the fixing of the color image is completed is transported toward an ejection portion, and the series of color image forming operations is completed.

Process Cartridge and Toner Cartridge

A process cartridge according to the exemplary embodiment will be described.

The process cartridge according to the exemplary embodiment is provided with a developing unit that accommodates the electrostatic charge image developer according to the exemplary embodiment and develops an electrostatic charge image formed on a surface of an image holding member with the electrostatic charge image developer as a toner image, and is detachable from an image forming apparatus.

The process cartridge according to the exemplary embodiment is not limited to the above-described configuration, and may be configured to include a developing machine and at least one selected from other units such as an image holding member, a charging unit, an electrostatic charge image forming unit, and a transfer unit.

Hereinafter, an example of the process cartridge according to this exemplary embodiment will be described. However, the process cartridge is not limited thereto. Major parts shown in the drawing will be described, but descriptions of other parts will be omitted.

Figure 3:
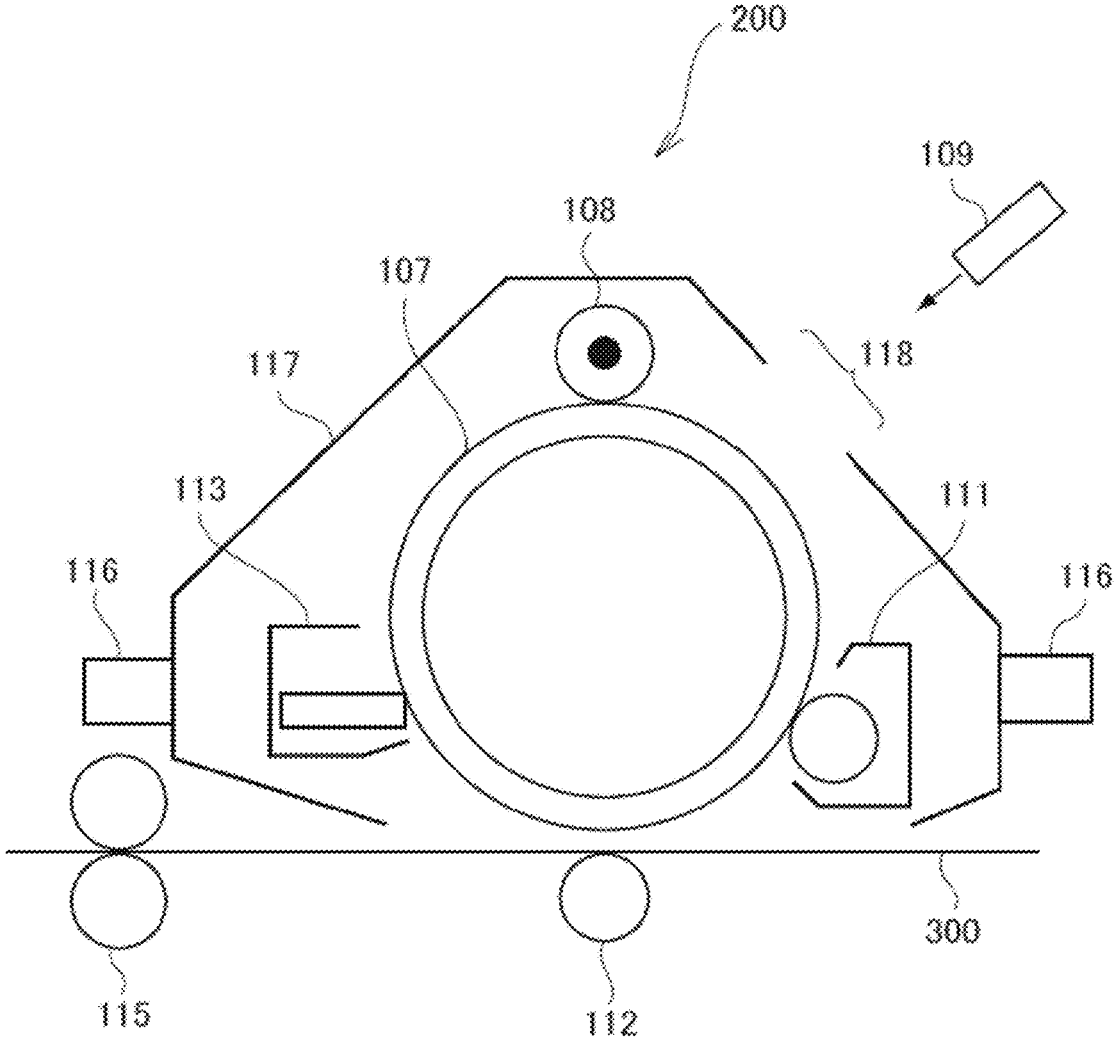
FIG. 3 is a configuration diagram illustrating an example of a process cartridge according to this exemplary embodiment.

FIG. 3 is a configuration diagram illustrating the process cartridge according to the exemplary embodiment.

The process cartridge 200 illustrated in FIG. 3 is configured such that a photosensitive body 107 (an example of the image holding member), a charging roll 108 (an example of the charging unit) which is provided in the vicinity of the photosensitive body 107, a developing machine 111 (an example of the developing unit), and a photosensitive body cleaning device 113 (an example of the cleaning unit) are integrally formed in combination, and are held by a housing 117 which is provided with an attached rail 116 and an opening portion 118 for exposing light.

Note that, in FIG. 3, reference numeral 109 is denoted as an exposure device (an example of the electrostatic charge image forming unit), reference numeral 112 is denoted as a transfer device (an example of the transfer unit), reference numeral 115 is denoted as a fixing device (an example of the fixing unit), and reference numeral 300 is denoted as a recording sheet (an example of the recording medium).

Next, the toner cartridge of the exemplary embodiment will be described.

The toner cartridge according to the exemplary embodiment accommodates the toner according to the exemplary embodiment and is detachable from an image forming apparatus. The toner cartridge contains the toner for replenishment for being supplied to the developing unit provided in the image forming apparatus.

The image forming apparatus as illustrated in FIG. 2 has such a configuration that the toner cartridges 8Y, 8M, 8C, and 8K are detachable therefrom, and the developing machines 4Y, 4M, 4C, and 4K are connected to the toner cartridges corresponding to the respective developing machines (colors) via toner supply tubes (not shown), respectively. In addition, in a case where the toner accommodated in the toner cartridge runs low, the toner cartridge is replaced.

EXAMPLES

Hereinafter, the present invention will be more specifically described by way of examples, but the present invention is not limited to the following examples as long as the gist thereof is not exceeded. In the following description, all "parts" and "%" are on a mass basis unless otherwise specified.

Synthesis of Crystalline Polyester Resin 1

225 parts of 1,10-dodecanedioic acid, 174 parts of 1,10-decanediol, and 0.8 parts of dibutyltin oxide as a catalyst are put into a heat-dried three-necked flask. After that, the air in the three-necked flask is replaced with nitrogen under a reduced pressure operation, and made into an inert atmosphere, and the mixture is stirred at 180° C. by mechanical stirring for 5 hours, and refluxed to advance the reaction. During the reaction, water generated in a reaction system is distilled off. Then, under reduced pressure, a temperature is gradually increased to 230° C., and the mixture is stirred for 2 hours, when it became viscous, molecular weight is checked by GPC, and when the weight average molecular weight reaches 17, 500, vacuum distillation is stopped, and thereby a crystalline polyester resin 1 is obtained.

Synthesis of amorphous polyester resin 1

Bisphenol A propylene oxide adduct: 367 parts
Bisphenol A ethylene oxide adduct: 230 parts
Terephthalic acid: 163 parts
Trimellitic anhydride: 20 parts
Dibutyltin oxide: 4 parts After putting the above components in a heat-dried three-necked flask, the air in a container is depressurized by a depressurizing operation to make further inert atmosphere with nitrogen gas, reaction is allowed for 10 hours at 230° C. at normal pressure (101.3 kPa) with mechanical stirring, and further reaction is allowed for 1 hour at 8 kPa. The mixture is cooled to 210° C., 4 parts of trimellitic anhydride is added thereto, reacted for 1 hour, and reacted at 8 kPa until the softening temperature reaches 118° C., and thereby an amorphous polyester resin 1 is obtained.

The softening temperature of the resin is set as a temperature at which a load of 1.96 MPa is applied to 1 g of sample with a plunger while heating the sample at a heating rate of 6° C./min by using a flow tester (CFT-5000 manufactured by Shimadzu Corporation), and then the sample is extruded from a nozzle of 1 mm in diameter and 1 mm in length such that a half of the sample flows out.

Synthesis of amorphous polyester resin 2

Bisphenol A propylene oxide adduct: 469 parts

Bisphenol A ethylene oxide adduct: 137 parts

Terephthalic acid: 152 parts

Fumaric acid: 20 parts

Dibutyltin oxide: 4 parts

After putting the above components in a heat-dried three-necked flask, the air in a container is depressurized by a depressurizing operation to make further inert atmosphere with nitrogen gas, reaction is allowed for 10 hours at 230° C. at normal pressure (101.3 kPa) with mechanical stirring, and further reaction is allowed for 1 hour at 8 kPa. The reaction mixture is cooled to 210° C., 4 parts of trimellitic anhydride is added, reacted for 1 hour, and reacted at 8 kPa until the softening temperature reaches 107° C., and thereby an amorphous polyester resin 2 is obtained.

The difference in SP value between the amorphous polyester resin 1 and the amorphous polyester resin 2 is calculated to be 0.14 by the method described above.

Production of crystalline polyester resin particle dispersion 1

100 parts of crystalline polyester resin 1, 40 parts of methyl ethyl ketone, and 30 parts of isopropyl alcohol are put into a separable flask, and are mixed well at 75° C. and dissolved, and 6.0 parts of 10% aqueous ammonia solution is added dropwise to the mixture. The heating temperature is lowered to 60° C., ion-exchanged water is added dropwise at a feed rate of 6 g/min using a feed pump while stirring, the solution become uniformly cloudy, and then the feed rate is raised to 25 g/min. When the solution volume reaches 400 parts, the adding dropwise of the ion exchange water is stopped. Thereafter, the solvent is removed under reduced pressure to obtain a crystalline polyester resin particle dispersion 1. The volume average particle diameter of the obtained crystalline polyester resin particle dispersion 1 is 168 nm, and the solid concentration is 11.5%.

Production of Amorphous Polyester Resin Particle Dispersion 1

Amorphous polyester resin 1: 300 parts

Methyl ethyl ketone: 218 parts

Isopropanol: 60 parts

10% aqueous ammonia solution: 10.6 parts

The above components (after removing insolubles with respect to the amorphous polyester resin) are put into a separable flask, mixed, and dissolved, and then ion exchanged water is added dropwise by a feed pump at a feed rate of 8 g/min while heating and stirring the mixture at 40° C. After the solution becomes cloudy, the liquid transfer speed is increased to 12 g/min to cause phase inversion, and when the liquid transfer amount reaches 1050 parts, adding dropwise is stopped. Thereafter, the solvent is removed under reduced pressure to obtain an amorphous polyester resin particle dispersion 1. The volume average particle diameter of the amorphous polyester resin particle dispersion 1 is 168 nm, and the solid concentration is 30%.

Production of Amorphous Polyester Resin Particle Dispersion 2

Amorphous polyester resin 2: 300 parts

Methyl ethyl ketone: 200 parts

Isopropanol: 50 parts

10% aqueous ammonia solution: 10.6 parts

The above components (after removing insolubles with respect to the amorphous polyester resin) are put into a separable flask, mixed, and dissolved, and then ion exchanged water is added dropwise by a feed pump at a feed rate of 8 g/min while heating and stirring the mixture at 40° C. After the solution becomes cloudy, the liquid transfer speed is increased to 12 g/min to cause phase inversion, and when the liquid transfer amount reaches 1050 parts, adding dropwise is stopped. Thereafter, the solvent is removed under reduced pressure to obtain an amorphous polyester resin particle dispersion 2. The volume average particle diameter of the amorphous polyester resin particle dispersion 2 is 160 nm, and the solid concentration is 30%.

Production of Amorphous Polyester Resin Particle Dispersion 3

An amorphous polyester resin particle dispersion 3 is obtained in the same manner except that the content of methyl ethyl ketone is changed to 300 parts in the amorphous polyester resin particle dispersion 2. The volume average particle diameter of the amorphous polyester resin particle dispersion 3 is 100 nm, and the solid concentration is 30%.

Production of Amorphous Polyester Resin Particle Dispersion 4

An amorphous polyester resin particle dispersion 4 is obtained in the same manner except that the content of methyl ethyl ketone is changed to 130 parts in the amorphous polyester resin particle dispersion 2. The volume average particle diameter of the amorphous polyester resin particle dispersion 4 is 250 nm, and the solid concentration is 30%.

Production of Amorphous Polyester Resin Particle Dispersion 5

An amorphous polyester resin particle dispersion 5 is obtained in the same manner except that the content of methyl ethyl ketone is changed to 150 parts in the amorphous polyester resin particle dispersion 5. The volume average particle diameter of the amorphous polyester resin particle dispersion 5 is 200 nm, and the solid concentration is 30%.

Vinyl/amorphous polyester composite resin particle dispersion 1 160 parts of amorphous polyester resin particle dispersion 2, 253 parts of ion exchanged water, 96 parts of butyl acrylate, and 3.6 parts of 10% aqueous ammonia solution are put into a 2 L cylindrical stainless steel container, and are dispersed and mixed for 10 minutes by setting the number of revolutions of a homogenizer (Ultra-Turrax T50, manufactured by IKA Co., Ltd.) to 10000 rpm. After that, a raw material dispersion is transferred to a polymerization kettle equipped with a stirring device using a two-paddle stirring blade to form a laminar flow, and a thermometer, and heating is started with a mantle heater under a nitrogen atmosphere by setting the number of revolutions of stirring to 200 rpm, and the mixture is kept at 75° C. for 30 minutes. Thereafter, a mixed solution of 1.8 parts of potassium persulfate (KPS) and 120 parts of ion exchanged water is added dropwise by a liquid feed pump over 120 minutes, and then kept at 75° C. for 210 minutes. After the liquid temperature is lowered to 50° C., 5.4 parts of an anionic surfactant (Neogen RK, manufactured by Daiichi Kogyo Seiyaku Co., Ltd.) is added to obtain a vinyl/amorphous polyester composite resin particle dispersion 1. The volume average particle diameter of the vinyl/amorphous polyester composite resin particle dispersion 1 is 220 nm, and the solid concentration is 32%.

Vinyl/Amorphous Polyester Composite Resin Particle Dispersion 2

A vinyl/amorphous polyester composite resin particle dispersion 2 is obtained in the same manner except that the amorphous polyester resin particle dispersion 2 is changed to the amorphous polyester resin particle dispersion 3, and the content of butyl acrylate is changed to 132 parts in the vinyl/amorphous polyester composite resin particle dispersion 1. The volume average particle diameter of the vinyl/amorphous polyester composite resin particle dispersion 2 is 130 nm, and the solid concentration is 32%.

Vinyl/Amorphous Polyester Composite Resin Particle Dispersion 3

A vinyl/amorphous polyester composite resin particle dispersion 3 is obtained in the same manner except that the amorphous polyester resin particle dispersion 2 is changed to the amorphous polyester resin particle dispersion 4, and the content of butyl acrylate is changed to 72 parts in the vinyl/amorphous polyester composite resin particle dispersion 1. The volume average particle diameter of the vinyl/amorphous polyester composite resin particle dispersion 3 is 320 nm, and the solid concentration is 32%.

Vinyl/Amorphous Polyester Composite Resin Particle Dispersion 4

A vinyl/amorphous polyester composite resin particle dispersion 4 is obtained in the same manner except that the amorphous polyester resin particle dispersion 2 is changed to the amorphous polyester resin particle dispersion 5, and the content of butyl acrylate is changed to 72 parts in the vinyl/amorphous polyester composite resin particle dispersion 1. The volume average particle diameter of the vinyl/amorphous polyester composite resin particle dispersion 4 is 220 nm, and the solid concentration is 32%.

Vinyl/Amorphous Polyester Composite Resin Particle Dispersion 5

A vinyl/amorphous polyester composite resin particle dispersion 5 is obtained in the same manner except that the content of butyl acrylate is changed to 132 parts in the vinyl/amorphous polyester composite resin particle dispersion 1. The volume average particle diameter of the vinyl/amorphous polyester composite resin particle dispersion 5 is 220 nm, and the solid concentration is 32%.

Vinyl/Amorphous Polyester Composite Resin Particle Dispersion 6

A vinyl/amorphous polyester composite resin particle dispersion 6 is obtained in the same manner except that the amorphous polyester resin particle dispersion 2 is changed to the amorphous polyester resin particle dispersion 3, and the content of butyl acrylate is changed to 102 parts in the vinyl/amorphous polyester composite resin particle dispersion 1. The volume average particle diameter of the vinyl/amorphous polyester composite resin particle dispersion 6 is 140 nm, and the solid concentration is 32%.

Vinyl/Amorphous Polyester Composite Resin Particle Dispersion 7

A vinyl/amorphous polyester composite resin particle dispersion 7 is obtained in the same manner except that the amorphous polyester resin particle dispersion 2 is changed to the amorphous polyester resin particle dispersion 4, and the content of butyl acrylate is changed to 36 parts in the vinyl/amorphous polyester composite resin particle dispersion 1. The volume average particle diameter of the vinyl/amorphous polyester composite resin particle dispersion 7 is 300 nm, and the solid concentration is 32%.

Vinyl/Amorphous Polyester Composite Resin Particle Dispersion 8

A vinyl/amorphous polyester composite resin particle dispersion 8 is obtained in the same manner except that the content of butyl acrylate is changed to 72 parts in the vinyl/amorphous polyester composite resin particle dispersion 1. The volume average particle diameter of the vinyl/amorphous polyester composite resin particle dispersion 8 is 190 nm, and the solid concentration is 32%.

Vinyl/Amorphous Polyester Composite Resin Particle Dispersion 9

A vinyl/amorphous polyester composite resin particle dispersion 9 is obtained in the same manner except that the amorphous polyester resin particle dispersion 2 is changed to the amorphous polyester resin particle dispersion 5, and the content of butyl acrylate is changed to 132 parts in the vinyl/amorphous polyester composite resin particle dispersion 1. The volume average particle diameter of the vinyl/amorphous polyester composite resin particle dispersion 9 is 260 nm, and the solid concentration is 32%.

In the vinyl/amorphous polyester composite resin particle dispersions 1 to 9, the glass-transition temperature Tg of the vinyl resin constituting the coating layer is lower than the temperature (110° C.) of the fixing device at the time of <image-forming> described later.

Production of Release Agent Dispersion 1

Paraffin wax (HNP9, manufactured by Nippon Seiro Co., Ltd.): 500 parts

Anionic surfactant (NEOGEN RK, manufactured by Daiichi Kogyo Seiyaku Co., Ltd.): 50 parts Ion exchange water: 1700 parts The above-described materials are mixed with each other, the mixture is heated at 110° C., is dispersed by using a homogenizer (Ultra-Turrax T50, manufactured by IKA Ltd.), and then is subjected to a dispersing treatment by using Manton-Gaulin high pressure homogenizer (manufactured by Manton Gaulin Mfg Company Inc), thereby producing a release agent dispersion 1 (solid content concentration: 32% by weight) in which a release agent having an average particle diameter of 180 nm is dispersed.

Production of Cyan Pigment Dispersion

Pigment Blue 15: 3 (manufactured by DIC): 200 parts

Anionic surfactant (NEOGEN R, manufactured by Daiichi Kogyo Seiyaku Co., Ltd.,): 1.5 parts Ion exchanged water: 800 parts The above components are mixed and dispersed about one hour by using a dispersing machine Cavitron (manufactured by Taiheiyo Kiko Co., Ltd., CR 1010) so as to obtain a Cyan pigment dispersion (solid content concentration: 20% by weight).

Production of Cyan Toner 1

Amorphous polyester resin particle dispersion 1: (amount indicated in Table 1)

Vinyl/amorphous polyester composite resin particle dispersion 1: (amount indicated in Table 1)

Crystalline polyester resin particle dispersion 1: (amount indicated in Table 1)

Release agent dispersion 1: 45 parts

Cyan pigment dispersion: 90 parts

Nonionic surfactant (IGEPALCA897): 1.40 parts

The above raw materials are put into a 2 L cylindrical stainless steel container, dispersed and mixed for 10 minutes while applying a shearing force at 4000 rpm with a homogenizer (Ultra-Turrax T50, manufactured by IKA Co., Ltd.). Then, 1.75 parts of a 10% nitric acid aqueous solution of polyaluminum chloride as a flocculant is gradually added dropwise, and the mixture is dispersed for 15 minutes and mixed by setting the number of revolutions of the homogenizer to 5000 rpm to obtain a raw material dispersion.

After that, a raw material dispersion is transferred to a polymerization kettle equipped with a stirring device using a two-paddle stirring blade to form a laminar flow, and a thermometer, and heating is started with a mantle heater by setting the number of revolutions of stirring to 550 rpm, and the mixture is kept at 49° C. to prompt the growth of aggregated particles. At this time, the pH of the raw material dispersion is controlled to a range of 2.2 to 3.5 with 0.3 N nitric acid or 1 N aqueous sodium hydroxide solution. The mixture is kept for about 2 hours in the range of the above pH to form an aggregated particle.

Next, 184 parts of an amorphous polyester resin particle dispersion 1 is additionally added to make the resin particle of the binder resin attached to the surface of the aggregated particle. The temperature is further raised to 53° C., and the aggregated particles are arranged while checking the particle size and morphology with an optical microscope and Multisizer II. After that, the pH is then adjusted to 7.8 with a 5% aqueous sodium hydroxide solution and kept for 15 minutes. Thereafter, the pH is raised to 8.0 to fuse the aggregated particle, and then the temperature was raised to 85° C. After checking that the aggregated particle is fused by an optical microscope, heating is stopped after 2 hours and cooling is performed at a temperature decrease rate of 1.0° C./min. Then, the resultant is sieved with a 20 μm mesh, repeatedly washed with water, and then dried with a vacuum dryer to obtain cyan toner particle 1.

Note that, regarding the obtained cyan toner particle 1, "presence or absence of the continuous phase and the discontinuous phase having the core and the coating layer", "the area occupied by the discontinuous phase with respect to the toner cross-sectional area [%]", "the average equivalent circle diameter L1 [nm] of the discontinuous phase", "the average thickness L2 [nm] of the coating layer", "L2/L1", "weight ratio C/A1 of the crystalline polyester resin 1 (C) to the amorphous polyester resin 1 (A1) contained in the continuous phase", and "when the boundary line having the same shape as a shape of the cross section of the toner and surrounding an area of 50% of the cross-sectional area of the toner is drawn coaxially on the cross section of the toner, the ratio a1/a2 of the area a1 of the discontinuous phase present inside the boundary line to the area a2 of the discontinuous phase present outside the boundary line" are each confirmed or measured by the above-described method. The results are indicated in Table 1.

0.5% of hexamethyldisilazane-treated silica having an average particle size of 40 nm and 0.7% of a titanium compound having an average particle size of 30 nm obtained by baking after treatment with 50% of isobutyl trimethoxy silane in metatitanic acid, in a weight ratio with respect to toner particles in each case, are added to the obtained Cyan toner particle 1, as external additives, and the resultant is mixed for 10 minutes with a 75 L Henschel mixer, after that, the mixture is sieved by a wind screen sieving machine Hi-Bolter 300 (manufactured by Shin-Tokyo machine company) so as to produce Cyan toner 1. The volume average particle diameter of the obtained Cyan toner 1 is 5.8 μm.

Production of Cyan Developer 1

Next, for 100 parts of ferrite core having an average particle diameter of 35 μm, 0.15 parts of vinylidene fluoride, and 1.35 parts of a copolymer of methyl methacrylate and trifluoroethylene (having a polymerization ratio of 80:20) resin are coated using a kneader to produce a carrier. The obtained carrier and cyan toner 1 are mixed in a 2-liter V blender at a ratio of 100 parts:8 parts, respectively, to produce a cyan developer 1.

Production of Cyan Toners 2 to 19 and Cyan Developers 2 to 19

Cyan toners 2 to 19 and Cyan developers 2 to 19 are produced in the same manner as the cyan toner 1 and the cyan developer 1 except that the types and additional amounts of the dispersions used are changed as illustrated in Table 1.

| Cyan toner | Cyan toner particle | Amorphous polyester resin particle dispersion 1 Additional amount [parts] | Crystalline polyester resin particle dispersion 1 Additional amount [parts] | Vinyl/amorphous polyester composite resin particle dispersion Kinds | Vinyl/amorphous polyester composite resin particle dispersion Additional amount [parts] | Presence or absence of continuous phase and discontinuous phase having core and coating layer | Area occupied by discontinuous phase with respect to toner cross-sectional area [%] | L1 [nm] | L2 [nm] | L2/L1 | C/A1 | [a1/a2] |
|---|---|---|---|---|---|---|---|---|---|---|---|---|
| 1 | 1 | 181 | 240 | 1 | 94 | Presence | 9 | 187 | 32 | 0.17 | 0.25 | 0.96 |
| 2 | 2 | 208 | 257 | 1 | 63 | Presence | 5 | 187 | 32 | 0.17 | 0.25 | 0.97 |
| 3 | 3 | 155 | 223 | 1 | 125 | Presence | 13 | 187 | 32 | 0.17 | 0.25 | 0.96 |
| 4 | 4 | 195 | 249 | 1 | 78 | Presence | 7 | 187 | 32 | 0.17 | 0.25 | 0.95 |
| 5 | 5 | 168 | 231 | 1 | 109 | Presence | 10 | 187 | 32 | 0.17 | 0.25 | 0.95 |
| 6 | 6 | 195 | 249 | 1 | 78 | Presence | 14 | 120 | 29 | 0.24 | 0.25 | 1.02 |
| 7 | 7 | 181 | 240 | 3 | 94 | Presence | 7 | 285 | 35 | 0.12 | 0.25 | 0.88 |
| 8 | 8 | 181 | 240 | 4 | 94 | Presence | 8 | 180 | 26 | 0.14 | 0.25 | 0.96 |
| 9 | 9 | 181 | 240 | 5 | 94 | Presence | 9 | 190 | 47 | 0.25 | 0.25 | 0.97 |
| 10 | 10 | 261 | 292 | — | — | Absence | — | — | — | — | 0.25 | — |
| 11 | 11 | 219 | 264 | 1 | 50 | Presence | 4 | 187 | 32 | 0.17 | 0.25 | 0.98 |
| 12 | 12 | 139 | 212 | 1 | 144 | Presence | 15 | 187 | 32 | 0.17 | 0.25 | 0.97 |
| 13 | 13 | 195 | 249 | 6 | 78 | Presence | 7 | 91 | 26 | 0.29 | 0.25 | 1.01 |
| 14 | 14 | 168 | 231 | 7 | 109 | Presence | 15 | 350 | 22 | 0.06 | 0.25 | 0.82 |
| 15 | 15 | 181 | 240 | 8 | 94 | Presence | 13 | 177 | 22 | 0.12 | 0.25 | 0.96 |
| 16 | 16 | 181 | 240 | 9 | 94 | Presence | 8 | 220 | 55 | 0.25 | 0.25 | 0.92 |
| 17 | 17 | 373 | 0 | — | — | Absence | — | — | — | — | 0.00 | — |
| 18 | 18 | 317 | 146 | — | — | Absence | — | — | — | — | 0.11 | — |
| 19 | 19 | 205 | 438 | — | — | Absence | — | — | — | — | 0.43 | — |

Image-Forming

A fixing unit of PREMAGE 355 manufactured by Toshiba Tec Corporation is removed, a coil spring of this fixing unit is replaced, a load to press a heating belt and a pressure roll is adjusted to 31 kgf, and wiring to supply power to the fixing unit is provided to function as a fixing test unit (fixing device).

On the other hand, in order to obtain an unfixed toner image, the fixing unit of DCIIC 7500 manufactured by Fuji Xerox Co., Ltd. is removed, and is modified so that the copy is discharged in an unfixed state. As an evaluation chart, the entire surface solid image adjusted so that the toner loading amount is 10.0 g/cm$^2$ is used. An unfixed toner image is produced in the environment of a temperature at 25° C. and a humidity at 90%.

Further, the fixing test unit is mounted so that the unfixed toner image produced flows into the fixing test unit. 500 images are continuously printed, and the presence or absence of image defects on the 50th and 500th sheets and the scratching strength are evaluated. The area in the image of the paper is 30%, the temperature of the fixing device is 110° C., 150° C., and 200° C., and SP paper and OS coated 127 gsm paper (both manufactured by Fuji Xerox Co., Ltd.) are used.

Evaluation Method of Image Defect (Durability, Hot Offset Resistance)

A case where at least one of missing, rough, and scratching images is observed when the fixed image is visually observed is defined as "visible", a case where at least one of missing, rough, and scratching images is slightly observed is defined as "slightly visible", a case where at least one of missing, rough, and scratching images is very slightly observed is defined as "very slightly", and a case where missing, rough, and scratching images are not observed is defined as "invisible".

The evaluation results are indicated in Table 2.

G0: Defect occurs in the entire image (cold offset occurs)

G1: At least one of missing, rough, and scratching images is observed

G2: At least one of missing, rough, and scratching images is slightly observed

G3: Image roughness is very slightly observed, but no problem in practical use

G4: Missing, rough, and scratching images are not observed.

Evaluation Method of Scratch Image Strength

The scratch image strength is evaluated at a pressure of 0.5 kg using a scratch-type hardness tester Model 318, manufactured by ERICHSEN GMBH & CO., KG.

The evaluation is as follows, and the evaluation results are indicated in Table 3.

A: Almost no decrease in density (muscle in image)

B: Density drop (muscles in the image) occurs but image is not peeled off.

C: A part of the image is peeled off.

D: Image defects are severe and unacceptable

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

TABLE 2

| | | SP paper | | | | | | OS coated 127 gsm paper | | | | | |
|---|---|---|---|---|---|---|---|---|---|---|---|---|---|
| | | 110° C. | | 150° C. | | 200° C. | | 110° C. | | 150° C. | | 200° C. | |
| | Cyan toner | 50-th sheet | 500-th sheet | 50-th sheet | 500-th sheet | 50-th sheet | 500-th sheet | 50-th sheet | 500-th sheet | 50-th sheet | 500-th sheet | 50-th sheet | 500-th sheet |
| Example 1 | 1 | G4 | G4 | G4 | G4 | G4 | G4 | G4 | G4 | G4 | G4 | G4 | G4 |
| Example 2 | 2 | G4 | G4 | G4 | G4 | G4 | G4 | G3 | G4 | G4 | G4 | G4 | G4 |
| Example 3 | 3 | G4 | G4 | G4 | G4 | G4 | G4 | G4 | G4 | G4 | G4 | G4 | G4 |
| Example 4 | 4 | G4 | G4 | G4 | G4 | G4 | G4 | G4 | G4 | G4 | G4 | G4 | G4 |
| Example 5 | 5 | G4 | G4 | G4 | G4 | G4 | G4 | G4 | G4 | G4 | G4 | G4 | G4 |
| Example 6 | 6 | G4 | G4 | G4 | G4 | G4 | G4 | G4 | G4 | G4 | G4 | G4 | G4 |
| Example 7 | 7 | G4 | G4 | G4 | G4 | G4 | G3 | G4 | G4 | G4 | G4 | G3 | G3 |
| Example 8 | 8 | G4 | G4 | G4 | G4 | G4 | G4 | G4 | G4 | G4 | G4 | G4 | G4 |
| Example 9 | 9 | G4 | G4 | G4 | G4 | G4 | G4 | G4 | G4 | G4 | G4 | G4 | G4 |
| Example 10 | 11 | G2 | G4 | G4 | G4 | G4 | G4 | G2 | G2 | G3 | G3 | G4 | G4 |
| Example 11 | 12 | G4 | G4 | G4 | G4 | G4 | G4 | G4 | G4 | G4 | G4 | G4 | G4 |
| Example 12 | 13 | G3 | G2 | G3 | G2 | G2 | G2 | G3 | G2 | G3 | G2 | G2 | G2 |
| Example 13 | 14 | G3 | G2 | G3 | G2 | G2 | G2 | G3 | G2 | G3 | G2 | G2 | G2 |
| Example 14 | 15 | G3 | G2 | G3 | G2 | G2 | G2 | G3 | G2 | G3 | G2 | G2 | G2 |
| Example 15 | 16 | G3 | G4 | G4 | G4 | G4 | G4 | G2 | G3 | G4 | G4 | G4 | G4 |
| Comparative Example 1 | 10 | G0 | G1 | G3 | G4 | G4 | G4 | G0 | G0 | G1 | G2 | G4 | G4 |
| Comparative Example 2 | 17 | G0 | G0 | G0 | G2 | G4 | G4 | G0 | G0 | G0 | G0 | G4 | G4 |
| Comparative Example 3 | 18 | G0 | G0 | G0 | G2 | G4 | G4 | G0 | G0 | G0 | G0 | G4 | G4 |
| Comparative Example 4 | 19 | G2 | G2 | G1 | G1 | G0 | G0 | G2 | G2 | G1 | G1 | G1 | G1 |

TABLE 3

| | | SP paper | | | | | | OS coated 127 gsm paper | | | | | |
|---|---|---|---|---|---|---|---|---|---|---|---|---|---|
| | | 110° C. | | 150° C. | | 200° C. | | 110° C. | | 150° C. | | 200° C. | |
| | Cyan toner | 50-th sheet | 500-th sheet | 50-th sheet | 500-th sheet | 50-th sheet | 500-th sheet | 50-th sheet | 500-th sheet | 50-th sheet | 500-th sheet | 50-th sheet | 500-th sheet |
| Example 1 | 1 | A | A | A | A | A | A | A | A | A | A | A | A |
| Example 2 | 2 | A | A | A | A | A | A | B | A | A | A | A | A |
| Example 3 | 3 | A | A | A | A | A | A | B | B | B | B | A | A |
| Example 4 | 4 | A | A | A | A | A | A | A | A | A | A | A | A |
| Example 5 | 5 | A | A | A | A | A | A | A | A | A | A | A | A |
| Example 6 | 6 | A | A | A | A | A | A | A | A | A | A | A | A |
| Example 7 | 7 | A | A | A | A, | A | A | A | A | A | A | A | A |
| Example 8 | 8 | A | A | A | A | A | A | A | A | A | A | A | A |
| Example 9 | 9 | A | A | A | A | A | A | A | A | A | A | A | A |
| Example 10 | 11 | A | A | A | A | A | A | A | A | A | A | A | A |
| Example 11 | 12 | A | A | A | A, | A | A | D | D | D | C | B | B |
| Example 12 | 13 | A | A | A | A | A | A | A | A | A | A | A | A |
| Example 13 | 14 | A | A | A | A | A | A | A | A | A | A | A | A |
| Example 14 | 15 | A | A | A | A | A | A | A | A | A | A | A | A |
| Example 15 | 16 | A | A | A | A | A | A | C | B | A | A | A | A |
| Comparative Example 1 | 10 | — | A | A | A | A | A | — | — | — | B | A | A |
| Comparative Example 2 | 17 | — | — | — | A | A | A | — | — | — | — | B | B |
| Comparative Example 3 | 18 | — | — | — | A | A | A | — | — | — | — | B | B |
| Comparative Example 4 | 19 | D | D | D | D | — | — | D | D | D | C | C | C |

What is claimed is:

1. An electrostatic charge image developing toner comprising:

a continuous phase containing a binder resin (i); and a discontinuous phase that has a core containing a binder resin (ii) and a coating layer covering the core and containing a binder resin (iii), and is dispersed in the continuous phase, wherein the continuous phase contains an amorphous polyester resin A1 and a crystalline polyester resin C as the binder resin (i), the core contains an amorphous polyester resin A2 as the binder resin (ii), and the coating layer contains a vinyl resin B as the binder resin (iii).

2. The electrostatic charge image developing toner according to claim 1, wherein in a cross-section of the toner, a ratio of an area occupied by the discontinuous phase to a cross-sectional area of the toner is 5% to 15%.

3. The electrostatic charge image developing toner according to claim 1, wherein the discontinuous phase has an average equivalent circle diameter of 100 nm to 300 nm.

4. The electrostatic charge image developing toner according to claim 1, wherein the coating layer has an average thickness of 25 nm to 50 nm.

5. The electrostatic charge image developing toner according to claim 1, wherein a ratio L2/L1 of an average thickness L2 of the coating layer to an average equivalent circle diameter L1 of the discontinuous phase is 0.12 to 0.25.

6. The electrostatic charge image developing toner according to claim 1, wherein the binder resin (iii) contained in the coating layer has a different structure as a component unit in a polymer chain with respect to the binder resin (i) contained in the continuous phase and the binder resin (ii) contained in the core.

7. The electrostatic charge image developing toner according to claim 1, wherein the binder resin (iii) contained in the coating layer forms a chemical bond at an interface between the core and the coating layer with respect to the binder resin (ii) contained in the core.

8. The electrostatic charge image developing toner according to claim 1, wherein a weight ratio of C/A1 of the crystalline polyester resin C contained in the continuous phase to the amorphous polyester resin A1 contained in the continuous phase is 0.12 to 0.40.

9. The electrostatic charge image developing toner according to claim 1, wherein a difference in a SP value of the amorphous polyester resin A1 and the amorphous polyester resin A2 is 0.20 or less.

10. The electrostatic charge image developing toner according to claim 1, wherein both of the amorphous polyester resin A1 and the amorphous polyester resin A2 have at least one of a structure derived from a bisphenol A propylene oxide adduct and a structure derived from a bisphenol A ethylene oxide adduct of 50% by weight or more in total.

11. The electrostatic charge image developing toner according to claim 1, wherein in a cross-section of the toner, when a boundary line having the same shape as a shape of the cross section of the toner and surrounding an area of 50% of a cross-sectional area of the toner is drawn coaxially on the cross section of the toner, a ratio a1/a2 of an area a1 of the discontinuous phase present inside the boundary line to an area a2 of the discontinuous phase present outside the boundary line is 0.8 to 1.2.

12. An electrostatic charge image developer comprising the electrostatic charge image developing toner according to claim 1.

13. A toner cartridge configured to accommodate the electrostatic charge image developing toner according to claim 1, wherein the toner cartridge is detachable from an image forming apparatus.

14. The electrostatic charge image developing toner according to claim 1, wherein the discontinuous phase has an average equivalent circle diameter of 120 nm to 250 nm.

* * * * *